US011118792B2

(12) United States Patent
Lee et al.

(10) Patent No.: US 11,118,792 B2
(45) Date of Patent: Sep. 14, 2021

(54) AIR CONDITIONER

(71) Applicant: Samsung Electronics Co., Ltd., Suwon-si (KR)

(72) Inventors: Won-Hee Lee, Yongin-si (KR); Jong Whal Kim, Suwon-si (KR); Jin-Gyun Kim, Seongnam-si (KR); Yeon-Seob Yun, Suwon-si (KR); Jun Seok Kwon, Anyang-si (KR); Sung Jae Kim, Seongnam-si (KR); Chang-Woo Jung, Suwon-si (KR); Ji Hong Kim, Suwon-si (KR); Moon Sun Shin, Suwon-si (KR); Seung Won Oh, Seongnam-si (KR); Sang Ki Yoon, Suwon-si (KR); Chang Sik Lee, Suwon-si (KR); Jae Rim Jung, Asan-si (KR); Seong Deok Cheon, Suwon-si (KR); Sung Hyun Chun, Suwon-si (KR); Weon Seok Choi, Seoul (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 274 days.

(21) Appl. No.: 15/209,948

(22) Filed: Jul. 14, 2016

(65) Prior Publication Data

US 2017/0016634 A1 Jan. 19, 2017

(30) Foreign Application Priority Data

Jul. 17, 2015 (KR) ..... 10-2015-0101932
Oct. 15, 2015 (KR) ..... 10-2015-0144355
Jan. 26, 2016 (KR) ..... 10-2016-0009493

(51) Int. Cl.
*F24F 1/00* (2019.01)
*F24F 1/0014* (2019.01)
(Continued)

(52) U.S. Cl.
CPC ..... *F24F 1/0014* (2013.01); *F24F 1/0003* (2013.01); *F24F 1/005* (2019.02);
(Continued)

(58) Field of Classification Search
CPC ..... F24F 1/0014; F24F 1/0003; F24F 1/0029; F24F 1/0033; F24F 13/082; F24F 13/085;
(Continued)

(56) References Cited

U.S. PATENT DOCUMENTS 3,426,512 A 2/1969 Nesher
2007/0129001 A1 6/2007 Orr
(Continued)

FOREIGN PATENT DOCUMENTS

CN 101080334 11/2007
CN 103528131 1/2014
(Continued)

OTHER PUBLICATIONS

Eum, Woo Chul, KR100748172 Tanslation.pdf, "Air Conditioner", Aug. 2007, pp. 1-8.*
(Continued)

*Primary Examiner* — Kenneth J Hansen
*Assistant Examiner* — Ryan L Faulkner
(74) *Attorney, Agent, or Firm* — Staas & Halsey, LLP

(57) ABSTRACT

An air conditioner includes a housing, a heat exchanger arranged to exchange heat with air flowing into the housing, a blower fan arranged inside the housing for discharging air that has exchanged heat with the heat exchanger to the outside and a discharging plate having an opening formed to discharge air blown from the blower fan out of the housing, and a plurality of discharging holes formed to discharge air to surroundings of the opening, wherein the discharging plate is arranged to discharge the air that has exchanged heat by the heat exchanger out of the housing, and wherein the
(Continued)

discharging plate is made of metal. By such configuration, air conditioner increase user satisfaction.

16 Claims, 32 Drawing Sheets

(51) Int. Cl.

| | |
|---|---|
| ***F24F 1/0003*** | (2019.01) |
| ***F24F 13/10*** | (2006.01) |
| ***F24F 13/08*** | (2006.01) |
| ***F24F 1/0029*** | (2019.01) |
| ***F24F 1/0033*** | (2019.01) |
| ***F24F 13/20*** | (2006.01) |
| ***F24F 1/005*** | (2019.01) |
| ***F24F 1/0007*** | (2019.01) |
| ***F24F 1/0043*** | (2019.01) |

(52) U.S. Cl.
CPC ..... *F24F 1/0007* (2013.01); *F24F 1/0029* (2013.01); *F24F 1/0033* (2013.01); *F24F 1/0043* (2019.02); *F24F 13/082* (2013.01); *F24F 13/085* (2013.01); *F24F 13/10* (2013.01); *F24F 13/20* (2013.01)

(58) Field of Classification Search
CPC ..... F24F 13/10; F24F 13/20; F24F 2001/004; F24F 2001/0074; F24F 13/08; F24F 13/1413; F16B 2/20; F16B 5/06; F16B 9/023; F16B 12/10
USPC ..... 454/233
See application file for complete search history.

(56) References Cited

U.S. PATENT DOCUMENTS

| | | | | |
|---|---|---|---|---|
| 2008/0119125 | A1* | 5/2008 | Guerreiro | B60H 1/345 454/75 |
| 2012/0190293 | A1 | 7/2012 | Badenhorst | |
| 2014/0000852 | A1* | 1/2014 | Kim | F24F 7/007 165/121 |

FOREIGN PATENT DOCUMENTS

| | | | |
|---|---|---|---|
| CN | 104236039 | | 12/2014 |
| EP | 1571401 | | 9/2005 |
| EP | 2208942 | | 7/2010 |
| GB | 2173292 | | 10/1986 |
| JP | 2004-176995 | | 6/2004 |
| JP | 2006215218 | | 8/2006 |
| JP | 3961013 | | 8/2007 |
| JP | 2008-161280 | | 7/2008 |
| JP | 2009-103401 | | 5/2009 |
| KR | 100748172 | B1 * | 8/2007 |
| KR | 20100027305 | A * | 3/2010 |
| KR | 10-2010-0083918 | | 7/2010 |
| KR | 10-1085896 | | 11/2011 |
| KR | 10-1240536 | | 3/2013 |
| KR | 10-2014-0019207 | | 2/2014 |
| KR | 10-1385292 | | 4/2014 |
| KR | 10-2015-0022416 | | 3/2015 |
| WO | 2006/009303 | | 1/2006 |

OTHER PUBLICATIONS

Park, Yun Suk, KR20100027305 Translation.pdf, "Air Conditioner", Mar. 2010, pp. 1-7.*
Korean Office Action dated Oct. 31, 2017 in Korean Patent Application No. 10-2016-0009493.
Korean Office Action dated Jun. 9, 2017 in Korean Patent Application No. 10-2016-0009493.
Extended European Search Report dated Aug. 1, 2017 in European Patent Application No. 16828009.7.
International Search Report dated Sep. 12, 2016 in International Patent Application No. PCT/KR2016/007738.
Korean Office Action dated Aug. 30, 2018 in Korean Patent Application No. 10-2017-0163266.
Australian Office Action dated Jul. 2, 2018 in Australian Patent Application No. 2016297374.
Korean Notice of Allowance dated Jan. 2, 2018 in Korean Patent Application No. 10-2016-0009493.
Korean Notice of Allowance dated Dec. 27, 2018 in Korean Patent Application No. 10-2017-0163266.
Russian Office Action dated Oct. 12, 2018 in Russian Patent Application No. 2018101456.
Australian Notice of Acceptance dated Dec. 21, 2018 in Australian Patent Application No. 2016297374.
U.S. Office Action dated Nov. 21, 2018 in U.S. Appl. No. 15/991,480.
U.S. Office Action dated Nov. 20, 2018 in U.S. Appl. No. 15/992,548.
U.S. Office Action dated Apr. 25, 2019 in U.S. Appl. No. 15/992,548.
U.S. Office Action dated Apr. 30, 2019 in U.S. Appl. No. 15/991,480.
European Communication dated Mar. 11, 2019 in European Patent Application No. 16828009.7.
European Communication dated Apr. 5, 2019 in European Patent Application No. 19150382.0.
Russian Decision to Grant dated Mar. 15, 2019 in Russian Patent Application No. 2018101456/12.
U.S. Office Action dated Sep. 19, 2019 in U.S. Appl. No. 15/992,548.
European Office Action dated Dec. 4, 2019 in European Patent Application No. 16828009.7.
Australian Office Action dated Nov. 27, 2019 in Australian Patent Application No. 2019202585.
Chinese Office Action dated Nov. 11, 2019 in Chinese Patent Application No. 201680015439.9.
U.S. Notice of Allowance dated Feb. 25, 2020 in U.S. Appl. No. 15/991,480.
U.S. Office Action dated Feb. 13, 2020 in U.S. Appl. No. 15/992,548.
Australian Office Action dated Mar. 6, 2020 in Australian Patent Application No. 2019202585.
Indian Office Action dated Jan. 14, 2020 in Indian Patent Application No. 201817006032.
Chinese Office Action dated Jun. 5, 2020 in Chinese Patent Application No. 201910039315.X.
Brazilian Office Action dated Jul. 7, 2020 in Brazilian Patent Application No. BR112018000101-5.
U.S. Office Action dated Aug. 7, 2020 in U.S. Appl. No. 15/992,548.
European Communication dated Dec. 2, 2020 in European Patent Application No. 19150382.0.
European Communication dated Dec. 2, 2020 in European Patent Application No. 20155644.6.
Chinese Office Action dated Jan. 15, 2021 in Chinese Patent Application No. 201910039315.X.
Chinese Office Action dated Jul. 24, 2020 in Chinese Patent Application No. 201680015439.9.
Office Action dated Jul. 9, 2021, in U.S. Appl. No. 15/992,548.

* cited by examiner

AIR CONDITIONER

CROSS-REFERENCE TO RELATED APPLICATIONS

This application claims priority to and the benefit of Korean Patent Applications No. 10-2015-0101932, filed on Jul. 17, 2015 in the Korean Intellectual Property Office, No. 10-2015-0144355, filed on Oct. 15, 2015 in the Korean Intellectual Property Office, and No. 10-2016-0009493, filed on Jan. 26, 2016 in the Korean Intellectual Property Office, the disclosures of which are incorporated herein by reference in their entirety.

BACKGROUND

1. Field

The following description relates to air conditioners, and more particularly, to an air conditioner employing different air discharging methods.

2. Description of the Related Art

In general, an air conditioner (AC) is a device for controlling temperature, humidity, etc., to be suitable for human activities and simultaneously, eliminating dust or other contaminants in the air by using refrigeration cycles. The refrigeration cycle performed using elements such as a compressor, a condenser, an evaporator, a blower fan, etc.

The ACs may be classified into split ACs with indoor and outdoor units separately installed, and packaged ACs with indoor and outdoor units installed together in a single cabinet. The indoor unit of the split AC includes a heat exchanger for exchanging heat of the air sucked into the panel, and a blower fan for sucking the room air into the panel and blowing the air back into the room.

The indoor units of conventional ACs are manufactured such that the heat exchanger is minimized in size and the air velocity and air volume are maximized by increasing revolutions per minute (rpm) of the blower fan. This reduces discharge temperature, and discharges the air into the room through a narrow and long fluid path.

When the user is directly exposed to the discharged air, he/she might feel cold and unpleasant, and on the contrary, when he/she is not exposed to the discharged air, he/she might feel hot and unpleasant.

Furthermore, increasing the rpm of the blower fan to achieve a high wind velocity may lead to a problem of increasing noise. As for an AC using radiation for air conditioning instead of the blower fan, it requires a large panel to have equal capabilities as in the blower fan based AC. This may slow down the cooling speed and increase installation costs.

SUMMARY

Additional aspects and/or advantages will be set forth in part in the description which follows and, in part, will be apparent from the description, or may be learned by practice of the invention.

The present disclosure provides an air conditioner (AC) employing different air discharging methods.

The present disclosure also provides an AC for cooling/heating the room at a minimum wind velocity at which the user may feel pleasant.

The present disclosure also provides an AC able to perform cooling through convection at a minimum wind velocity and cooling through radiation using a cold air area formed in a neighboring section.

According to an aspect of the present disclosure, an air conditioner (AC) includes a housing, a heat exchanger arranged to exchange heat with air flowing into the housing, a blower fan arranged inside the housing for discharging air that has exchanged heat with the heat exchanger to the outside and a discharging plate having an opening formed to discharge air blown from the blower fan out of the housing, and a plurality of discharging holes formed to discharge air to surroundings of the opening, wherein the discharging plate is arranged to discharge the air that has exchanged heat by the heat exchanger out of the housing, and wherein the discharging plate is made of metal.

The plurality of discharging holes are formed on the discharging plate by a press forming process.

The discharging plate includes a first plate combiner arranged along the circumference of the discharging plate to correspond to a first projection arranged along at least a portion of the circumference of the housing, such that the discharging plate is fixed to the housing when the first projection is inserted to the first plate combiner.

The air conditioner may further include a fluid path shaping frame confining a fluid path to guide air discharged from the blower fan and a discharging guide arranged between the fluid path shaping frame and the discharging plate for guiding airflow from the blower fan to the opening, wherein the discharging plate includes a second plate combiner arranged along the circumference of the opening to correspond to a second projection arranged along at least a portion of the circumference of the discharging guide, such that the discharging guide is fixed to the discharging plate when the second projection is inserted to the second plate combiner.

The air conditioner may further include a fluid path shaping frame confining a fluid path to guide air discharged from the blower fan and a discharging guide arranged between the fluid path shaping frame and the discharging plate for guiding airflow from the blower fan to the opening, wherein the discharging plate include a plurality of first plate combiners formed along the circumference of the discharging plate, and combined with the housing by being bent and a plurality of second plate combiners formed along the circumference of the opening, and combined with the discharging guide by being bent.

According to an aspect of the present disclosure, an air conditioner (AC) includes a housing, a heat exchanger arranged inside the housing for exchanging heat with air, a blower fan arranged inside the housing for discharging air that has exchanged heat with the heat exchanger to the outside, a discharging panel arranged to discharge the air that has exchanged heat by the heat exchanger out of the housing, and having a first discharger arranged to discharge air blown by the blower fan out of the housing and a second discharger arranged to discharge the air through a different path from the first discharger and a combining guide arranged between the discharging panel and the housing to combine the discharging panel with the housing.

The combining guide includes a first combiner for combination with the housing and a second combiner for combination with the discharging panel.

The combining guide is integrally formed with the housing.

The combining guide is integrally formed with the discharging panel.

The discharging panel includes a fluid path shaping frame and a discharging plate to form a fluid path for discharging the heat exchanged air, wherein the combining guide is combined with the fluid path shaping frame and the discharging plate.

According to an aspect of the present disclosure, an air conditioner (AC) includes a housing, a heat exchanger arranged inside the housing for exchanging heat with air flowing from the outside, a frame arranged for partitioning the inside of the housing and a discharging plate arranged to have a plurality of discharging holes to discharge the heat exchanged air and to form a space with the frame, wherein the discharging plate comprises a plate flange arranged to bend along at least a portion of the circumference of the discharging plate and to form a gap from one side of the housing.

The discharging plate is arranged to form the gap between an inner side of the housing and an outer side of the plate flange.

The air conditioner may further include a separation member located between the plate flange and the housing, such that the plate flange is separated from one side of the housing.

The housing includes a facing face to face the plate flange, wherein the separation member protrudes from the facing face to separate the plate flange from the facing face.

The separation member has a plurality of separation members arranged to be separated from each other along the facing face.

The air conditioner may further include a combining guide arranged between the frame and the housing for combining the frame with the housing, wherein the separation member is formed on the combining guide.

The combining guide is integrally formed with the housing.

The air conditioner includes a combining guide arranged between the frame and the housing for combining the frame with the housing, wherein the combining guide comprises a first separation projection protruding from one side of the housing to form a gap between the plate flange and the one side of the housing to separate the one side of the housing from the plate flange, wherein the frame comprises a second separation projection protruding from one side of the frame to form a gap between the plate flange and the one side of the frame to separate the one side of the frame from the plate flange, The air conditioner may further include a combining guide arranged between the frame and the housing for combining the frame with the housing, wherein the combining guide comprises a fixing groove concavely formed on one side of the combining guide, wherein the plate flange comprises a fixing projection inserted and fixed to the fixing groove to maintain the gap.

BRIEF DESCRIPTION OF THE DRAWINGS

The above and other objects, features and advantages of the present disclosure will become more apparent to those of ordinary skill in the art by describing in detail exemplary embodiments thereof with reference to the accompanying drawings, in which.

DETAILED DESCRIPTION

Figure 1:
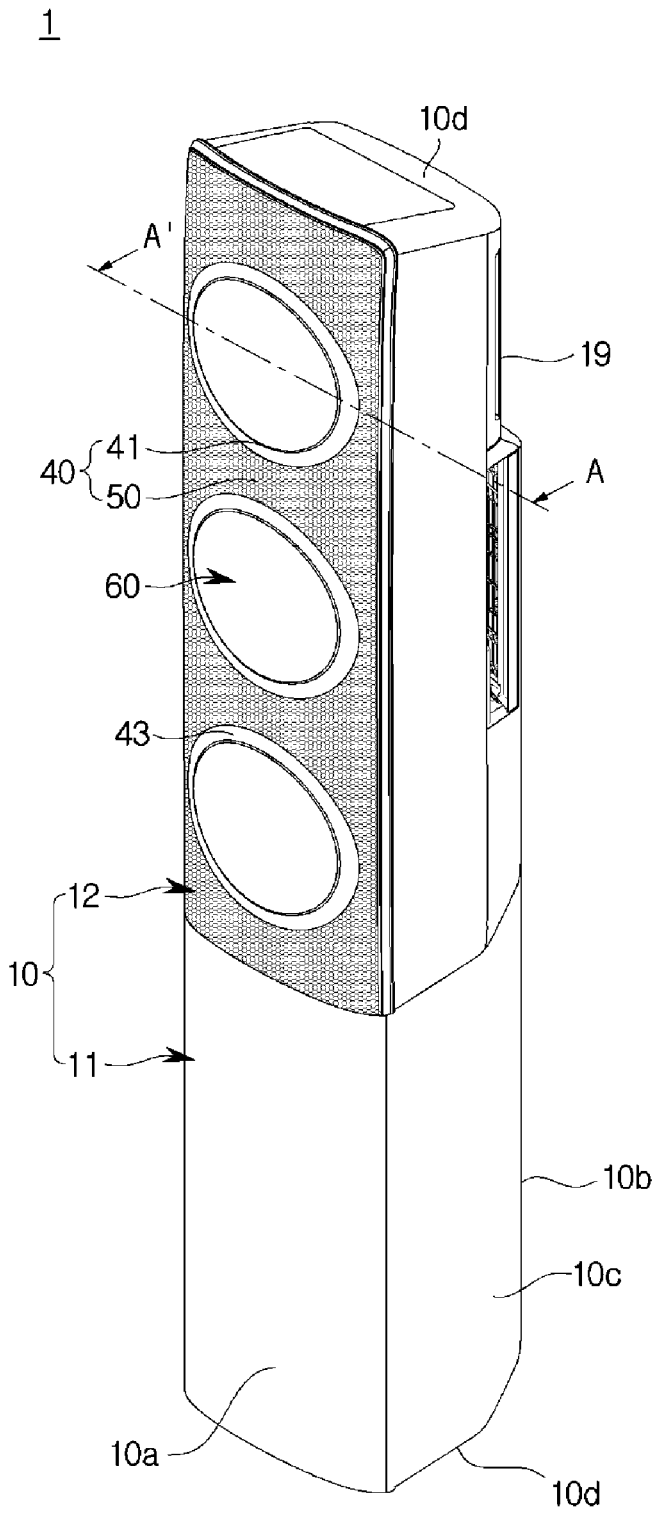
FIG. 1 is a perspective view of an AC, according to an embodiment of the present disclosure.

Reference will now be made in detail to the embodiments, examples of which are illustrated in the accompanying drawings, wherein like reference numerals refer to like elements throughout. The embodiments are described below to explain the present disclosure by referring to the figures.

Embodiments and features as described and illustrated in the present disclosure are only preferred examples, and various modifications thereof may also fall within the scope of the disclosure.

Throughout the drawings, like reference numerals refer to like parts or components.

The terminology used herein is for the purpose of describing particular embodiments only and is not intended to limit the present disclosure. It is to be understood that the singular forms "a," "an," and "the" include plural references unless the context clearly dictates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The terms including ordinal numbers like "first" and "second" may be used to explain various components, but the components are not limited by the terms. The terms are only for the purpose of distinguishing a component from another. Thus, a first element, component, region, layer or section discussed below could be termed a second element, component, region, layer or section without departing from the teachings of the present disclosure. Descriptions shall be understood as to include any and all combinations of one or more of the associated listed items when the items are described by using the conjunctive term "~and/or~," or the like.

Reference will now be made in detail to embodiments, examples of which are illustrated in the accompanying drawings, wherein like reference numerals refer to the like elements throughout.

A refrigeration cycle of an Air conditioner (AC) is comprised of a compressor, a condenser, an expansion valve, and an evaporator. The refrigeration cycle circulates in a series of processes of compression, condensing, expansion, and evaporation, enabling heat exchange between high temperature air and low temperature refrigerants and then supplying the cooled air into the room.

The compressor compresses a gas refrigerant into a high temperature and high pressure state and discharges the compressed gas refrigerant, and the discharged gas refrigerant flows into the condenser. The condenser condenses the compressed gas refrigerant into a liquid state, releasing heat to the surroundings. The expansion valve expands the high temperature and high pressure liquid refrigerant condensed by the condenser to low pressure liquid refrigerant. The evaporator evaporates the refrigerant expanded by the expansion valve. The evaporator achieves a cooling effect using latent heat of vaporization of the refrigerant to exchange heat with an object to be cooled, and has low temperature and low pressure gas refrigerant return to the compressor. Through this refrigeration cycle, the temperature of indoor air may be controlled.

An outdoor unit of an AC refers to a part comprised of the compressor of the refrigeration cycle, and an outdoor heat exchanger. The expansion valve may be placed in one of the indoor or outdoor units, and the indoor heat exchanger is placed in the indoor unit of the AC.

In the present disclosure, an AC for cooling the room is provided, where the outdoor heat exchanger serves as the condenser while the indoor heat exchanger serves as the evaporator. Hereinafter, for convenience of explanation, an indoor unit including the indoor heat exchanger is called an AC, and the indoor heat exchanger is called a heat exchanger.

FIG. 1 is a perspective view of an AC, according to an embodiment of the present disclosure.

An indoor unit of an AC 1 may include a housing 10 having at least one opening 17 and forming the exterior of the indoor unit, a heat exchanger 20 for exchanging heat with the air flowing into the housing 10, a blower 30 for circulating air into or out of the housing 10, and an air discharger 40 for discharging the air blown from the blower 30 out of the housing 10.

The housing 10 may include a front panel 10*a* with the at least one opening 17 formed thereon, a back panel 10*b* arranged in the back of the front panel 10*a*, side panels 10*c* arranged between the front and back panels 10*a* and 10*b*, and top/bottom panels 10*d* arranged on the top/bottom of the side panels 10*c*. The at least one opening 17 may have a circular shape, and at least two or more openings 17 may be arranged on the front panel 10*a* at predetermined intervals in the vertical direction. The back panel 10*b* may have an inlet 19 formed to suck the outside air into the housing 10.

The inlet 19 formed on the back panel 10*b* arranged in the back of the heat exchanger 20 may guide the air outside the housing 10 to flow into the housing 10. The air flowing into the housing 10 through the inlet 19 absorbs or loses heat while passing the heat exchanger 20. The air that has exchanged heat while passing the heat exchanger 20 is discharged by the blower 30 out of the housing 10 through an outlet.

The blower 30 may include a blower fan 32 and a blower grill 34.

The blower grill 34 may be arranged in the direction in which the blower fan 32 discharges air. In the embodiment, the blower fan 32 may be a mixed flow fan without being limited thereto, and may be any kind of fan that moves the outside air into the housing 10 and discharges the air out of the housing 10. For example, the blower fan 32 may be a cross fan, a turbo fan, or a sirocco fan. There is no limitation on the number of the blower fans 32, and in the embodiment of the present disclosure, there may be at least one blower fan 32 corresponding to the at least one opening. The blower fan 32 may be arranged in front of the inlet 19, and the heat exchanger 20 may be arranged between the blower fan 32 and the inlet 19. A first discharger 41 may be arranged in front of the blower fan 32.

The blower 30 may have a fan driver 33 arranged in the center of the blower fan 32 for driving the blower fan 32. The fan driver 33 may include a motor.

The blower grill 34 may be arranged in front of the blower fan 32 for guiding airflow. Furthermore, the blower grill 34 may be arranged between the blower fan 32 and the air discharger 40 for minimizing the influence of the outside condition on the blower fan 32.

The blower grill 34 may include a plurality of wings 35. The plurality of wings 35 may control the direction or the volume of the air blown from the blower fan 32 to the air discharger 40 by controlling the number, shape, and/or angle of disposition of the wings 35.

As will be described later, a door operating part 66 may be arranged in the center of the blower grill 34. The door operating part 66 and the fan driver 33 may be aligned in the back and forth direction. With the arrangement, the plurality of wings 35 of the blower grill 34 may be arranged in front of the fan wings of the blower fan 32.

The blower 30 may include a duct 36. The duct 36 may be formed to have a circular shape that encloses the blower fan 32 to guide airflow of the air flowing into the blower fan 32. In other words, the air sucked in through the inlet 19 and having passed the heat exchanger 20 may be guided to flow into the blower fan 32.

The heat exchanger 20 is arranged between the blower fan 32 and the inlet 19 for absorbing heat from or transferring heat to the air flowing in through the inlet 19. The heat exchanger 20 may include a tube 21, and headers 22 combined on the upper and bottom sides of the tube 21. However, the type of the heat exchanger 20 is not limited thereto.

There may be at least one heat exchanger 20 arranged inside the housing 10 to correspond to the number of the openings.

The air discharger 40 is arranged in the housing 10 for discharging the air that has exchanged heat inside the housing 10 out of the housing 10. The air discharger 40 may include a first discharger 41 and a second discharger 50, which will be described later.

Figure 2:
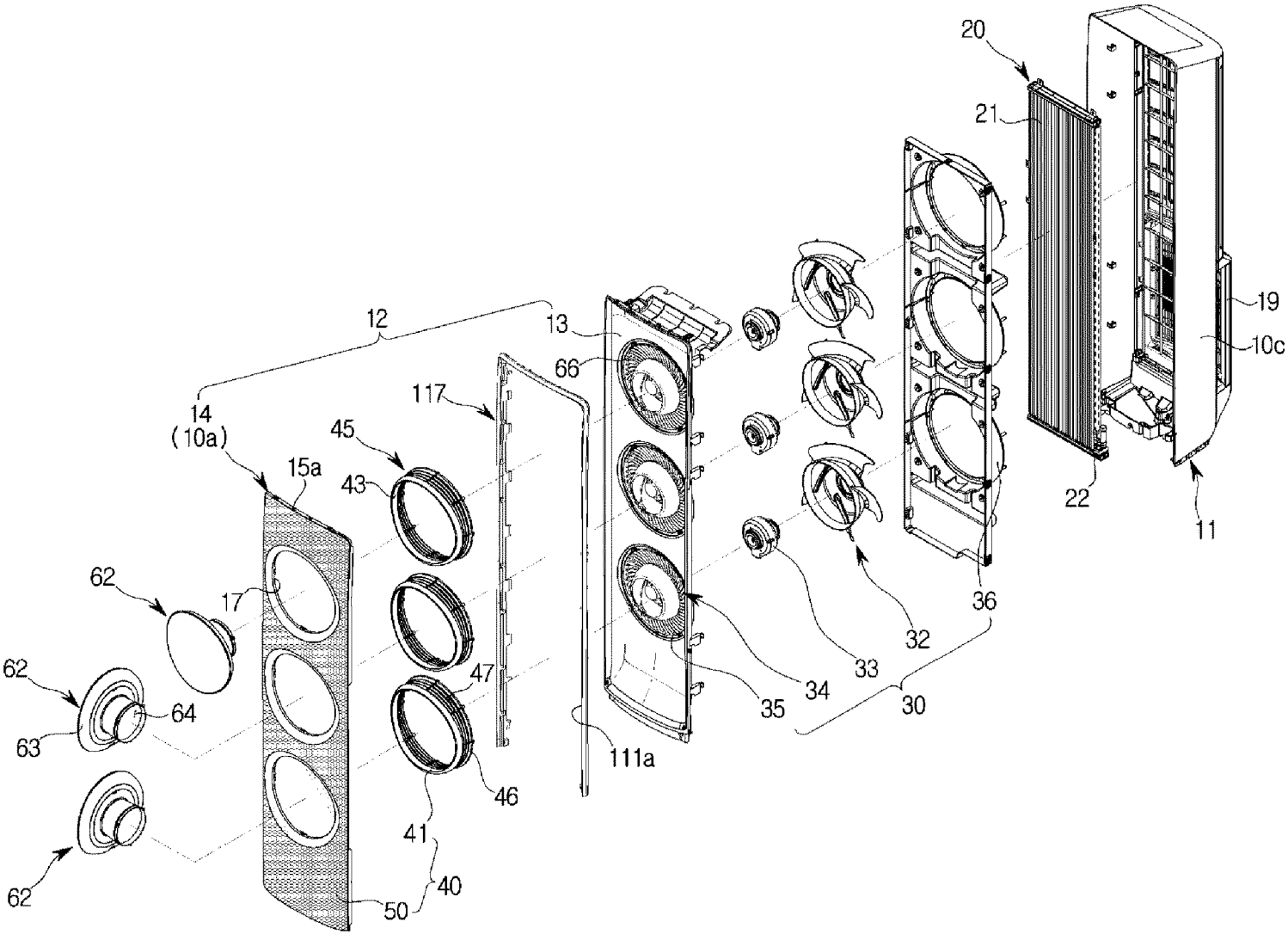
FIGS. 2 and 3 are exploded views of an AC, according to an embodiment of the present disclosure.
Figure 3:
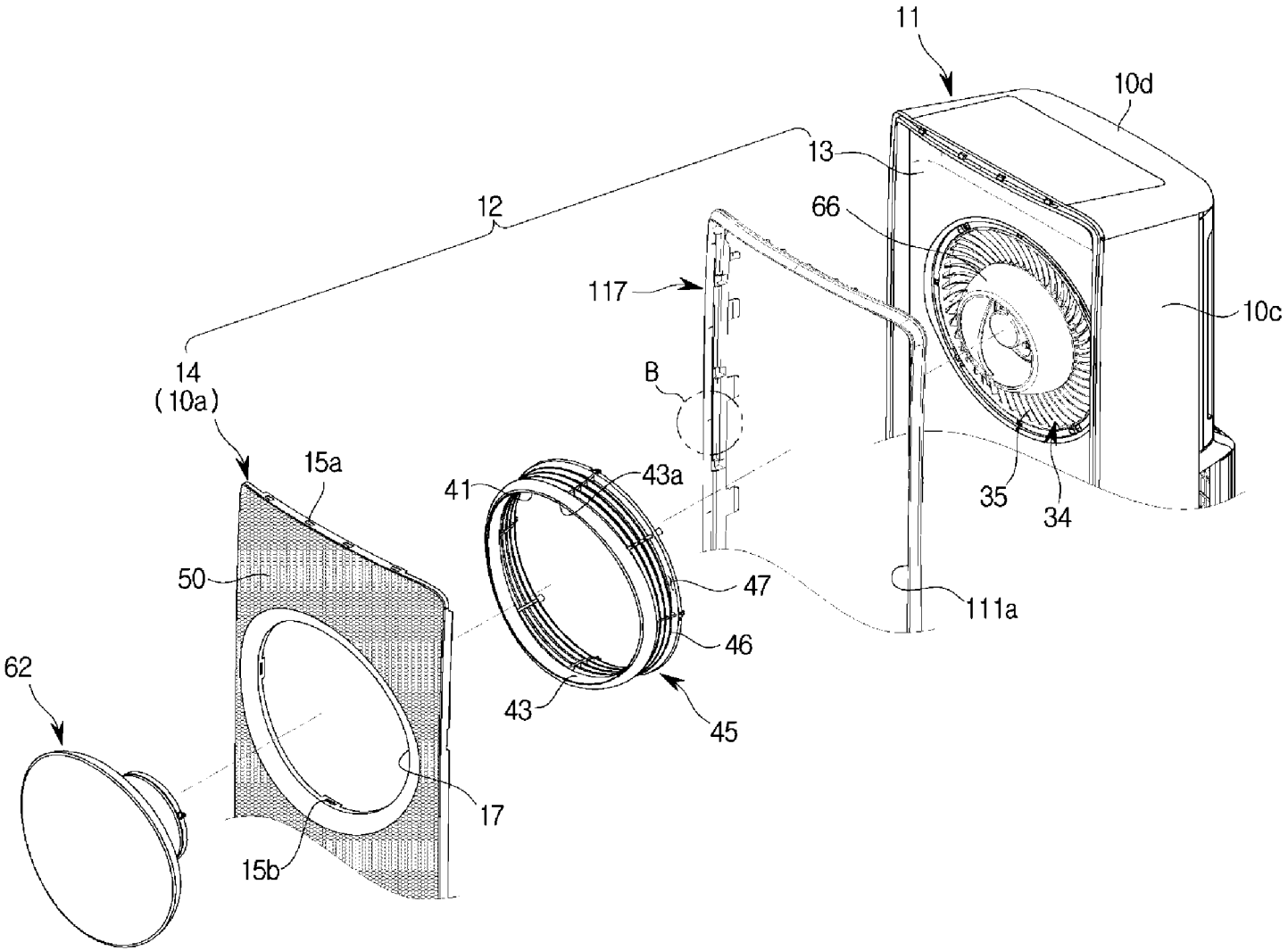
Figure 4:
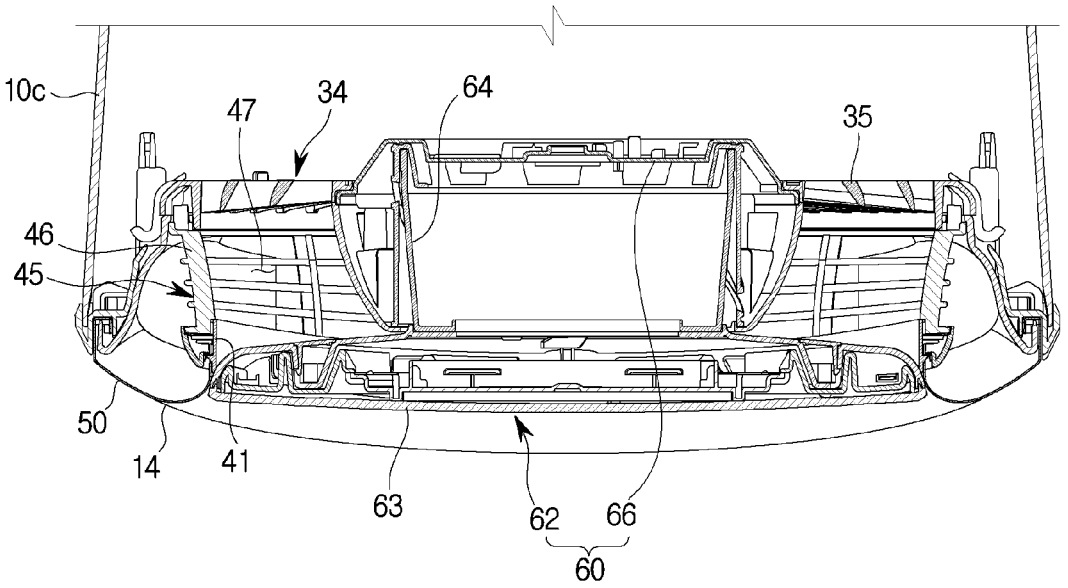
FIG. 4 is a cross-sectional view of the AC cut along the line A-A' of FIG. 1.

FIGS. 2 and 3 are exploded views of an AC, according to an embodiment of the present disclosure, and FIG. 4 is a cross-sectional view of the AC cut along the line A-A' of FIG. 1.

The AC 1 may be configured to operate in different operation modes. The operation modes may include a first mode for discharging the heat exchanged air to the opening 17 formed on the housing 10, and a second mode for discharging the heat exchanged air to a discharging plate 14 formed on the housing 10. In addition, there may be a third mode for discharging the heat exchanged air both to the opening 17 and the discharging plate 14. The discharging plate 14 will be described later.

In the respective first, second, and third modes, the heat exchanged air may be discharged through at least one of the first and second dischargers 41 and 50. The heat exchanged air may also be discharged both to the first and second dischargers 41 and 50. In other words, the air that has exchanged heat by the heat exchanger 20 may be discharged by the blower fan 32 out of the AC 1 through at least one of the first and second dischargers 41 and 50.

In the first mode, the heat exchanged air is discharged to the first discharger 41, in which case the heat exchanged air is not entirely discharged to the first discharger 41 but partly discharged to the second discharger 50. That is, in the first mode, the majority of the heat exchanged air is discharged to the first discharger 41. Even in the second mode, as in the first mode, the majority of the heat exchanged air is discharged to the second discharger 50.

The air that has passed the blower 30 may be discharged out of the housing 10 through the air discharger 40.

Again, the air discharger 40 may include the first discharger 41 and the second discharger 50. The heat exchanged air may be discharged through at least one of the first and second dischargers 41 and 50. Furthermore, the heat exchanged air may be selectively discharged through at least one of the first and second dischargers 41 and 50.

The first discharger 41 may discharge air through an opening formed on the housing 10. While the AC 1 is operating in the first mode, the heat exchanged air may be discharged out of the housing 10 through the first discharger 41. The first discharger 41 is formed to discharge the heat exchanged air directly to the outside. The first discharger 41 may be formed to be exposed outside the housing 10.

The first discharger 41 may be arranged in the blowing direction of the blower fan 32 for discharging the heat exchanged air directly to the outside. In other words, the first discharger 41 is arranged in front of the blower fan 32 of the blower 30 such that the air blown from the blower 30 is discharged directly to the first discharger 41.

The air blown from the blower fan 32 may flow through a first discharging fluid path 41*a* (see FIG. 9) formed between the blower fan 32 and the first discharger 41. The first discharging fluid path 41*a* may be formed by a discharging guide 45.

The first discharger 41 may be formed by a guide opening 43. The guide opening 43 may be formed to be connected to the opening 17 and form the first discharger 41 along the inner circumference of the guide opening 43. The guide opening 43 may be formed to be exposed outside through the opening 17 of the housing 10, and formed to enable a door unit 60, which will be described below, to be safely placed in the guide opening 43. The guide opening 43 may be arranged in the opening 17 of the housing 10 and may form the first discharger 41 along the inner circumference of the guide opening 43.

The first discharger 41 may be formed to be opened/shut by the door unit 60.

The door unit 60 opens/shuts the first discharger 41, and is formed to discharge the heat exchanged air out of the housing 10 selectively through the first discharger 41. The door unit 60 may control the heat exchanged air to flow to at least one of the first and second dischargers 41 and 50 by opening/shutting the first discharger 41.

The door unit 60 is formed to be movable between a door open position 60*a* (see FIGS. 8 and 9) to open the first discharger 41 and a door shut position 60*b* (see FIGS. 10 and 11) to shut the first discharger 41. The door unit 60 may be formed to be movable between the door open position 60*a* and the door shut position 60*b* back and forth.

Specifically, the door unit 60 may include a door blade 62, and a door operating part 66 for operating the door blade 62.

The door blade 62 may be shaped like a circle corresponding to the shape of the first discharger 41. When the door unit 60 is in the door open position 60*a*, the door blade 62 is arranged to be at some distance from the guide opening 43, and when the door unit 60 is in the door shut position 60*b*, the door blade 62 is arranged to contact the guide opening 43 to shut the first discharger 41.

The door blade 62 may include a blade body 63 having a circular form to correspond to the first discharger 41, and a blade combiner 64 formed to extend from the blade body 63 to be combined with the door operating part 66.

The blade body 63 may be shaped like almost a round plate. Furthermore, the blade body 63 may be formed such that one side of the blade body 63 faces the outside of the housing 10 and the other side of the blade body 63 faces the blower 30.

A display is arranged on one side of the blade body 63 for displaying operation states of the AC 1 or allowing the user to manipulate the AC 1.

The door operating part 66 may be formed for the door blade 62 to be movable. The door operating part 66 may include a motor (not shown). The door operating part 66 may be combined with the blade combiner 64 of the door blade 62 to move the door blade 62.

The aforementioned blower grill 34 may be arranged along the circumference of the door operating part 66. The air blown from the blower fan 32 arranged on the back of the blower grill 34 may pass the blower grill 34 and be discharged ahead.

The second discharger 50 may be arranged to discharge air through an outer panel. While the AC 1 is operating in the second mode, the heat exchanged air may be discharged out of the housing 10 through the second discharger 50. This arrangement enables the heat exchanged air to be discharged to the outside while the wind velocity of the heat exchanged air is reduced. The second discharger 50 may be formed on the discharging plate 14, which will be described below, and may include a plurality of discharging holes bored through the inner and outer sides of the discharging plate 14. The opening 17 of the housing 10 may be arranged on the discharging plate 14 as shown in FIGS. 2 and 4, without being limited thereto. For example, it is also possible for the opening 17 and the discharging plate 14 to be arranged on the different sides of the housing 10.

In the case that the heat exchanged air is discharged out of the housing 10 through the second discharger 50, the air blown by the blower fan 32 may flow through the second discharging fluid path 50*a* formed between the blower fan 32 and the second discharger 50. The second discharging fluid path 50*a* may be formed by the discharging guide 45 and a discharging panel 12, which will be described below.

The external panel may include an exterior panel 11 forming the exterior, and the discharging panel 12 formed to discharge the heat exchanged air. The discharging panel 12 may be part of the external panel, or may be part of the discharger. The exterior panel 11 may form a panel opening with the front open, and the discharging panel 12 may be placed in the panel opening for enabling the heat exchanged air to be discharged out of the AC through the discharging panel 12.

The discharging panel 12 may be arranged to form the second discharging fluid path 50*a*. The heat exchanged air may be discharged out of the AC 1 through the second discharging fluid path 50*a* formed by the discharging panel 12 and through the discharging plate 14 as will be described below, at a low velocity.

In the embodiment of the present disclosure, the discharging panel 12 is arranged on the front of the AC 1 as shown in FIGS. 1, 2, and 3, without being limited thereto. For example, the discharging panel 12 may be arranged on at least one of the front, the right side, the left side, the rear side, and the top of the AC 1.

The discharging panel 12 may include a fluid path shaping frame 13 and the discharging plate 14.

The fluid path shaping frame 13 is formed to guide the air that has exchanged heat on an inner side of the discharging plate 14 to the discharging plate 14. The fluid path shaping frame 13 may be formed to partition the inside of the housing 10 from the second discharging fluid path 50*a*. The fluid path shaping frame 13 may prevent the heat exchanged air from flowing back into the housing 10. In the embodiment of the present disclosure, the fluid path shaping frame 13 may be formed to extend from the blower grill 34 to be connected to the exterior panel 11.

The second discharger 50 may be formed on the discharging plate 14. The discharging plate 14 and the second discharger 50 may be collectively called a plate discharger. The discharging plate 14 may be arranged to cover the panel opening.

The shape of the second discharger 50 has no limitation, but in the embodiment of the present disclosure, may have the form of a plurality of discharging holes. The second discharger 50 may be formed to bore through the front and back faces of the discharging plate 14. The discharging plate 14 may be arranged on an outer side compared to the fluid path shaping frame 13, forming the second discharging fluid path 50*a* with the fluid path shaping frame 13.

The second discharger 50 may include a discharging area formed on at least a portion of the discharging plate 14. In the discharging area, a plurality of discharging holes may be formed such that they are uniformly distributed or concentrated in at least a portion of the discharging area. In the embodiment of the present disclosure, the discharging area has a plurality of uniformly distributed holes.

The discharging area may be formed at least a portion of the discharging plate 14. It is, however, not limited thereto, but may be formed all over the discharging plate 14.

In the aforementioned third mode, the heat exchanged air is divided to the first and second dischargers 41 and 50 and discharged. An amount of division for each discharger may depend on settings, or may be adjusted by the controller.

The air discharger 40 may include the first discharging fluid path 41*a* for guiding the heat exchanged air to the first discharger 41, and the second discharging fluid path 50*a* for guiding the heat exchanged air to the second discharger 50. The first and second discharging fluid paths 41*a* and 50*a* may be referred to as a discharging fluid path and a radiation discharging fluid path, respectively.

The air blown by the blower fan 32 may flow through at least one of the first and second discharging fluid paths 41*a* and 50*a*.

In the first mode, the air blown by the blower fan 32 may flow through the first discharging fluid path 41*a* formed between the blower fan 32 and the first discharger 41. In the second mode, the air blown by the blower fan 32 may flow through the second discharging fluid path 50*a* formed between the blower fan 32 and the second discharger 50.

The air discharger 40 may include a discharging guide 45. The air blown by the blower fan 32 may be controlled by the discharging guide 45. The discharging guide 45 may be arranged in front of the blower 30 for enabling the air flowing from the blower 30 to flow through at least one of the first and second discharging fluid paths 41*a* and 50*a*.

The discharging guide 45 may include a guide body 46 and a guide groove 47.

The guide body 46 may be formed to form the first discharging fluid path on the inside. The guide body 46 may be shaped like a cylinder with a cavity. Specifically, the guide body 46 may have the form of a pipe with one side facing the blower 30 and the other side facing the first discharger 41.

The guide groove 47 may be formed for the second discharging fluid path 50*a* to pass through. The guide groove 47 may be formed on the guide body 46. There is no limitation on the shape of the guide groove 47, and the guide groove 47 may have any shape if only it is formed on the guide body 46 for enabling the air to flow to the outer direction of the guide body 46. In the embodiment of the present disclosure, the guide groove 47 may be formed to have a plurality of halls along the circumference of the guide body 46.

In the first mode, the door unit 60 opens the first discharger 41. In this case, the air blown from the blower 30 passes the first discharging fluid path 41*a* formed inside of the guide body 46 and is discharged to the first discharger 41.

In the second mode, the door unit 60 shuts the first discharger 41. In this case, one side of the guide body 46 is shut by the door unit 60, forcing the air blown from the blower 30 to pass the guide groove 47 formed on the guide body 46 and is discharged to the second discharger 50.

An area of the first discharger 41 may be twice the area of the second discharger 50. Specifically, total area of the plurality of discharging holes of the second discharger 50 may be 0.5 times or more than the area of a first discharging hole 42 (see FIG. 9) formed between the first discharger 41 and the door unit 60. Furthermore, total area of the plurality of discharging holes of the second discharger 50 may be 10 times or less than the area of the first discharging hole 42 formed between the first discharger 41 and the door unit 60. With this structure, while the AC is operating in the first mode, the air may be easily blown to the first discharger 41 or the first discharging hole 42 rather than to the second discharger 50. The area of the second discharger 50 has no limitation. For example, the plurality of discharging holes of the second discharger 50 may each have the area of 0.05 $mm^2$ or more. It is because the air may not easily flow to the second discharger 50 if each of the plurality of discharging holes has the area of 0.05 $mm^2$ or less. In an example, each of the plurality of discharging holes of the second discharger 50 may have the area of 5 $mm^2$ or less. The respective discharging holes may have equal or different areas.

Figure 5:
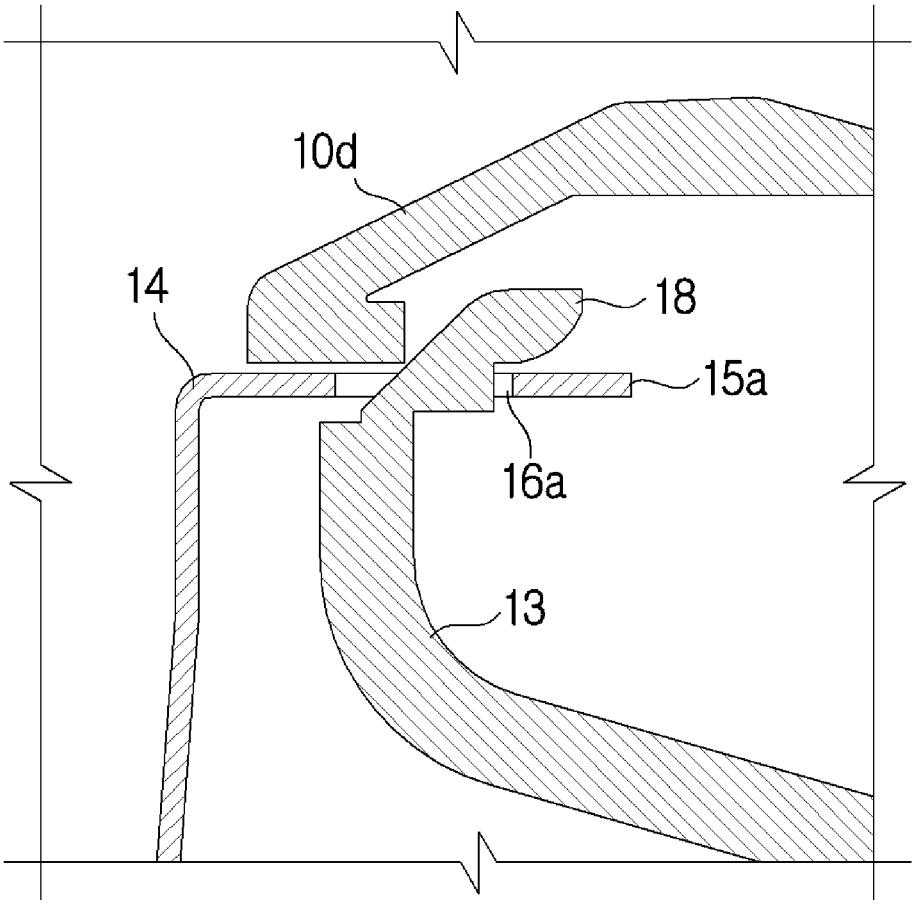
FIG. 5 shows combination of a discharging plate and a housing, according to an embodiment of the present disclosure.
Figure 6:
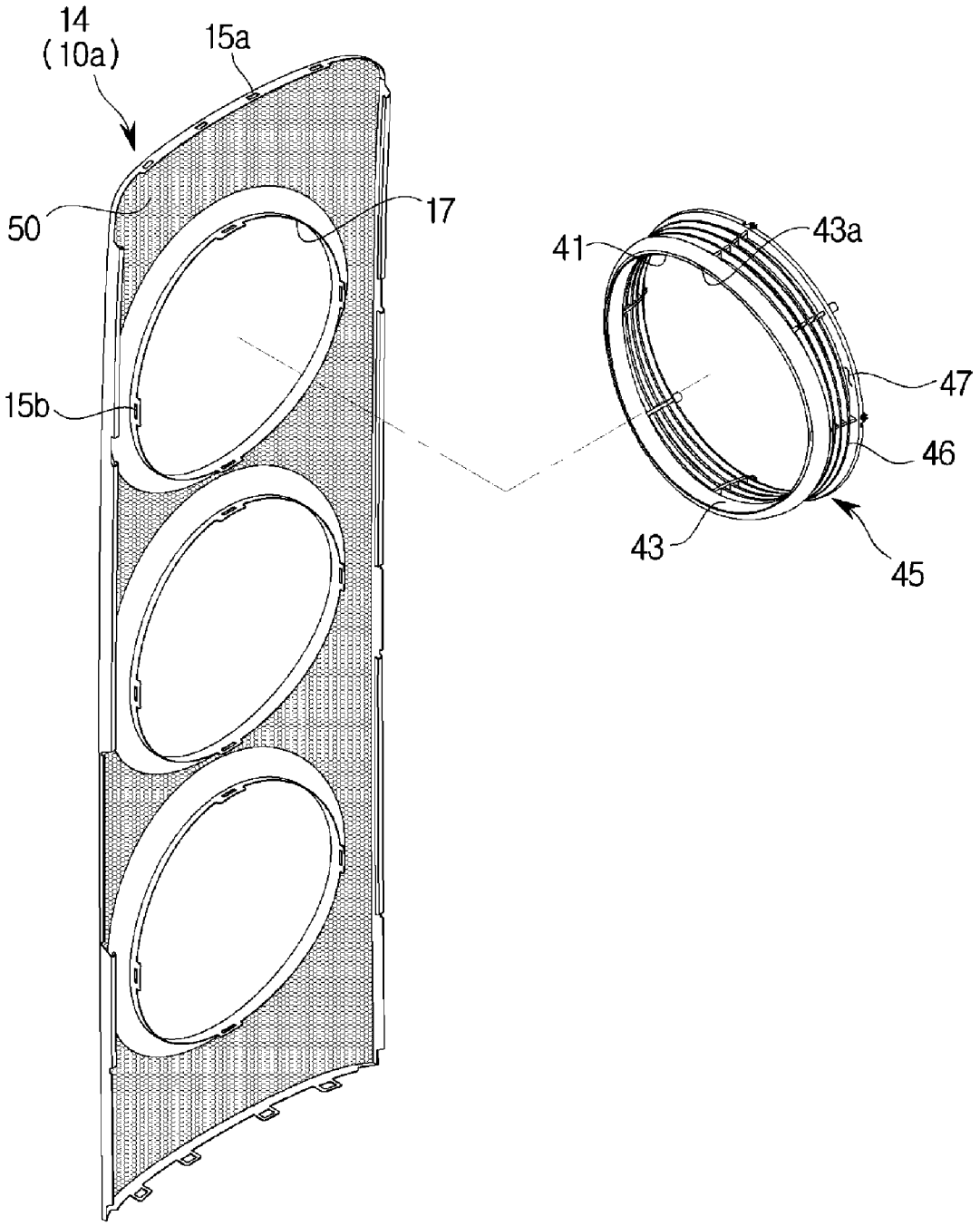
FIGS. 6 and 7 show combination of a discharging plate and a guide opening, according to an embodiment of the present disclosure.
Figure 7:
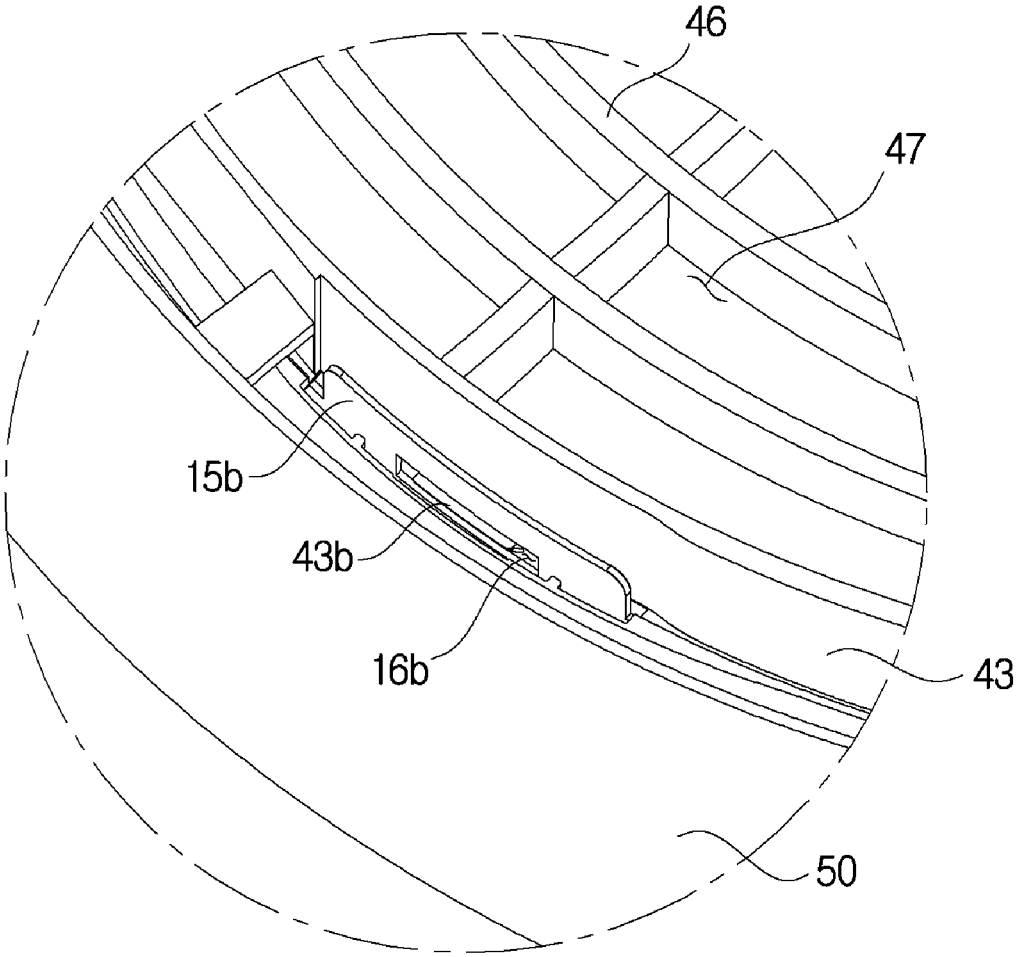

FIG. 5 shows a combination of a discharging plate and a housing, according to an embodiment of the present disclosure, and FIGS. 6 and 7 show a combination of a discharging plate and a guide opening, according to an embodiment of the present disclosure.

The discharging plate 14 may include plate combiners 15*a*, 15*b*. The plate combiners 15*a*, 15*b* may be formed to combine the discharging plate 14 with the housing 10 or the guide opening 43.

The plate combiner 15*a* may be formed along the contour of the discharging plate 14 for combination with the housing 10. The plate combiner 15*b* may be formed along the contour of the opening 17 of the discharging plate 14 for combination with the guide opening 43.

The plate combiners 15*a*, 15*b* may be formed to protrude from the discharging plate 14. The plate combiners 15*a*, 15*b* may include plate rabbet grooves 16*a*, 16*b* shaped like holes, to catch projections 17, 43*b*, which will be described later.

The plate combiners 15*a*, 15*b* may include the first plate combiner 15*a* to combine the discharging plate 14 with the housing 10, and the second plate combiner 15*b* to combine the discharging plate 14 with the guide opening 43.

At least one first plate combiner 15*a* may be arranged along the contour of the discharging plate 14. The first plate combiner 15*a* is combined with the housing 10 to combine the housing 10 and the discharging plate 14.

A first projection 18 may be arranged on the housing 10 at a position corresponding to the first plate combiner 15*a*. In the embodiment of the present disclosure, the first projection 18 is arranged at a position corresponding to the first plate combiner 15*a* on the outer edge of the fluid path shaping frame 13. However, where to arrange the first projection 18 is not limited thereto, if only the first projection 18 is arranged to correspond to the first plate combiner 15*a* such that the housing 10 and the discharging plate 14 are combined.

As shown in FIG. 5, in a case of having the discharging plate 14 closely contact the housing 10, the first plate rabbet groove 16*a* of the first plate combiner 15*a* is formed to catch the first projection 18. This enables the discharging plate 14 to be attached onto the housing 10.

There is no limitation on the number of the first plate combiners 15*a* and the number of the first projections 18.

At least one second plate combiner 15*b* may be arranged along the contour of the opening 17, as shown in FIG. 6. The second plate combiner 15*b* is combined with the guide opening 43 to combine the guide opening 43 and the discharging plate 14.

A guide insertion groove 43*a* may be formed in the guide opening 43 for the second plate combiner 15*b* to be inserted thereto. When the discharging plate 14 and the guide opening 43 have close contact with each other, the second plate combiner 15*b* may be inserted through the guide insertion groove 43*a*, passing through the guide opening 43. The guide insertion groove 43*a* may be arranged along the circumference of the guide opening 43 to correspond to the second plate combiner 15*b* arranged on the outer edge of the opening.

The second plate combiner 15*b* may be inserted into the guide insertion groove 43*a* such that the second projection 43*b* is caught in the second plate rabbet groove 16*b*, thereby combining the discharging plate 14 and the guide opening 43. As such, combining the discharging plate 14 and the guide opening 43 may connect the opening 17 and the first discharger 41.

There is no limitation on the number of the second plate combiners 15*b*, second projections 43*b*, and guide insertion grooves 43*a*, but in the embodiment of the present disclosure, the second plate combiners 15*b*, second projections 43*b*, and guide insertion grooves 43*a* all have four each.

Operation of the AC in accordance with an embodiment of the present disclosure will now be described.

FIGS. 8, 9, 10, and 11 illustrate operation of an AC, according to an embodiment of the present disclosure.

The air flowing into the housing 10 from outside exchanges heat with the heat exchanger 20. The air that has been air-conditioned by the heat exchanger 20 is discharged by the blower 30 out of the housing 10.

The AC 1 discharges the air that has passed the heat exchanger 20 through at least one of the first and second dischargers 41 and 50. For example, the AC 1 may discharge the air through the first discharger 41 to perform intensive air conditioning in the first mode, or may discharge the air through the second discharger 50 to slow down air conditioning all over the room in the second mode.

The first discharger 41 may be opened/shut by operation of the door unit 60. If the first discharger 41 is opened, the heat exchanged air is discharged through the first discharger 41, and if the first discharger 41 is shut, the heat exchanged air is discharged through the second discharger 50.

Operation of the AC 1 in the first mode will now be described in more detail.

Figure 8:
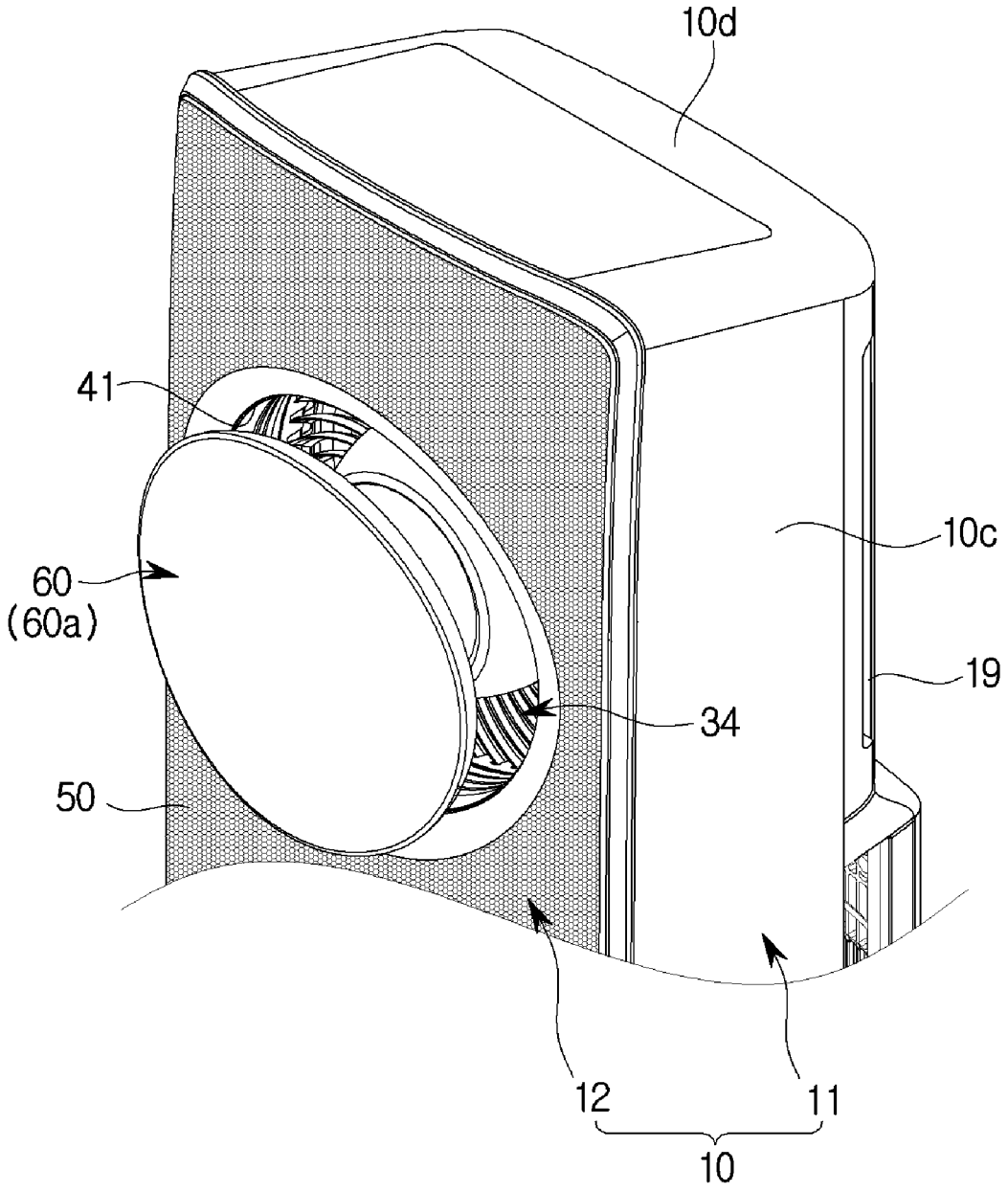
FIGS. 8, 9, 10, and 11 illustrate operation of an AC, according to an embodiment of the present disclosure.
Figure 9:
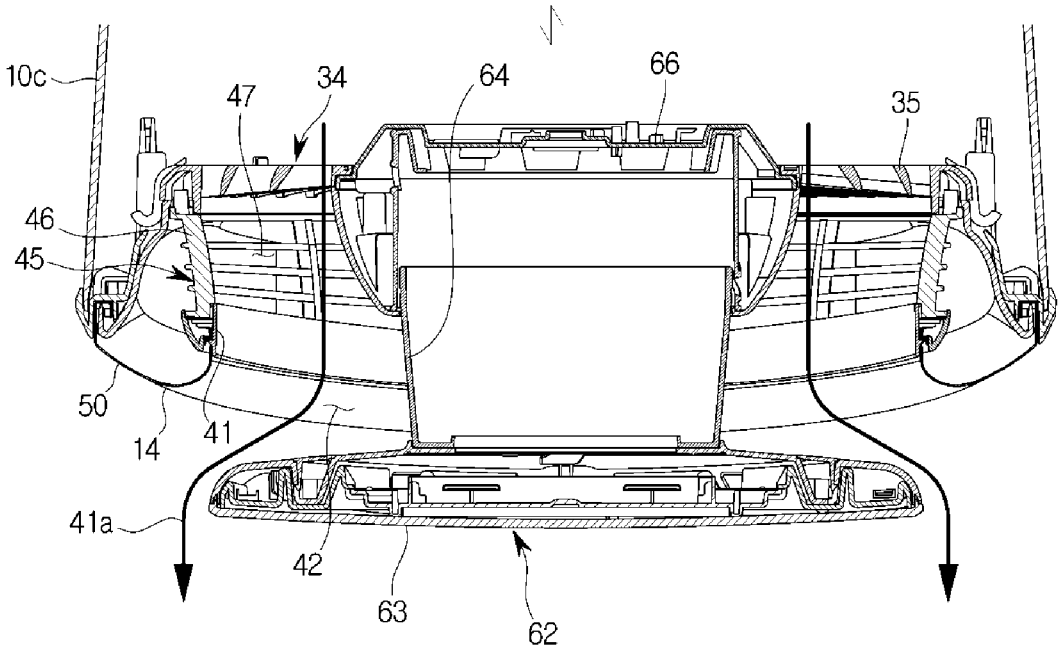

FIGS. 8 and 9 illustrate an AC operating in the first mode.

In the first mode, the heat exchanged air is discharged through the first discharger 41. In the first mode, when the door unit 60 is in the door open position 60*a*, the door blade 62 is at some distance from the guide opening 43, enabling the first discharger 41 to be opened.

In this case, the air flowing from the blower 30 flows through the first discharging fluid path 41*a* formed by the guide body 46 to the first discharger 41.

In this case where the air is discharged out of the housing 10 through the first discharger 41, the wind velocity of the blower 30 remains constant.

Operation of the AC 1 in the second mode will now be described in more detail.

Figure 10:
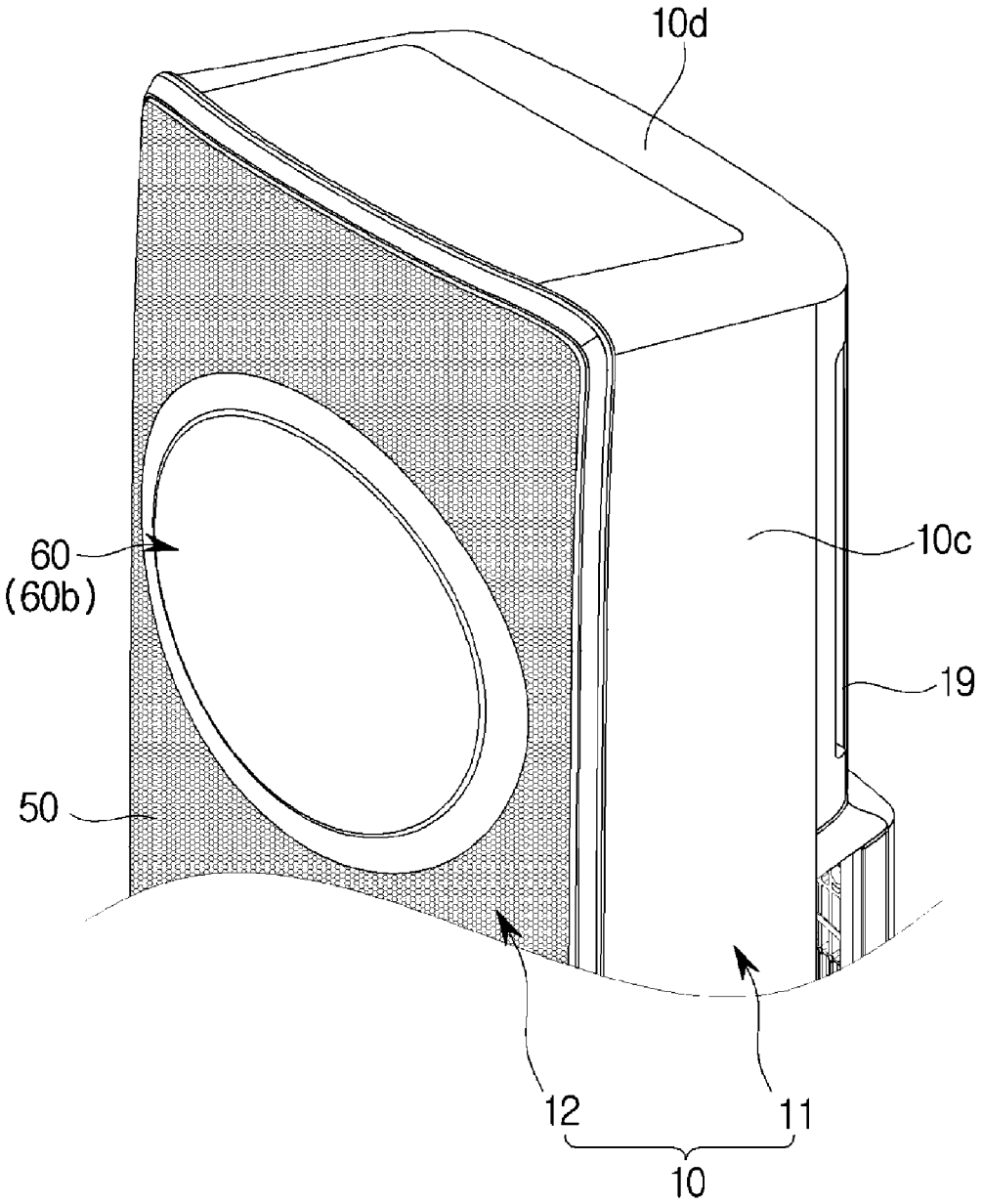
Figure 11:
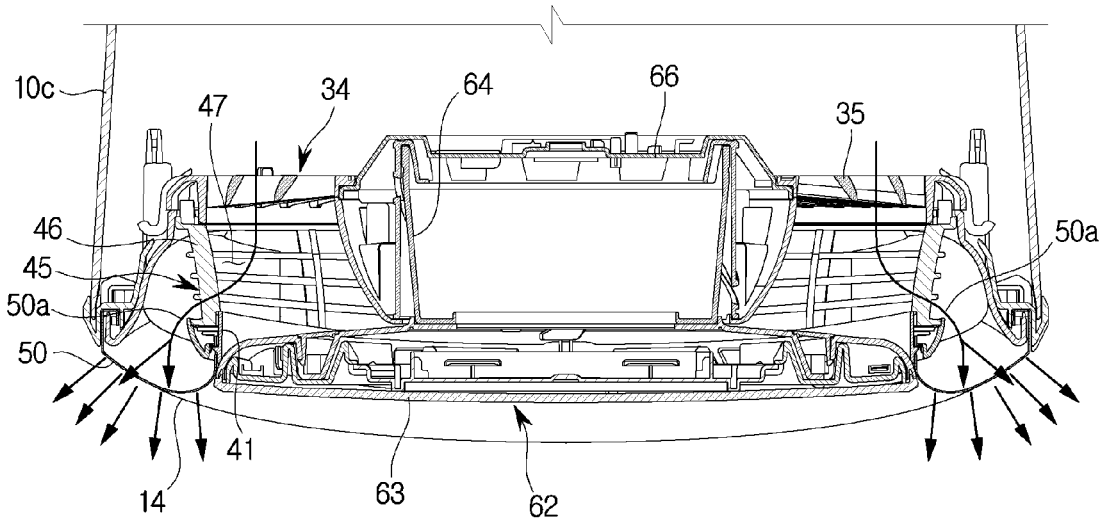

FIGS. 10 and 11 illustrate an AC operating in the second mode.

In the second mode, the heat exchanged air is discharged through the second discharger 50. In the second mode, when the door unit 60 is in the door shut position 60*b*, the door blade 62 comes into contact with the guide opening 43 to shut the first discharger 41.

In this case, the air flowing from the blower 30 passes the guide groove 47 formed on the guide body 46 because the first discharger 41 is blocked by the door blade 62. Thus, the air flowing from the blower 30 flows through the second discharging fluid path 50*a* to the second discharger 50.

In this case where the air is discharged out of the housing 10 through the second discharger 50, the air slows down while passing the plurality of discharging holes of the discharging plate 14 and is discharged to the outside at a low velocity.

With this structure, the AC 1 may cool or heat the room at a wind velocity that makes the user feel pleasant.

The first and second dischargers 41 and 50 may also be called a high-rate discharger and a low-rate discharger, respectively.

Operation of the AC 1 in the third mode will now be described in more detail.

In the third mode, the heat exchanged air is discharged out of the housing 10 by being divided into the first and second dischargers 41 and 50. An amount of division for each discharger may depend on settings or may be adjusted by the controller. Alternatively, it may be adjusted depending on the surrounding conditions sensed by some temperature sensor.

An AC in accordance with an embodiment of the present disclosure will now be described.

Arrangements overlapping with what are described above will be omitted herein.

Figure 12:
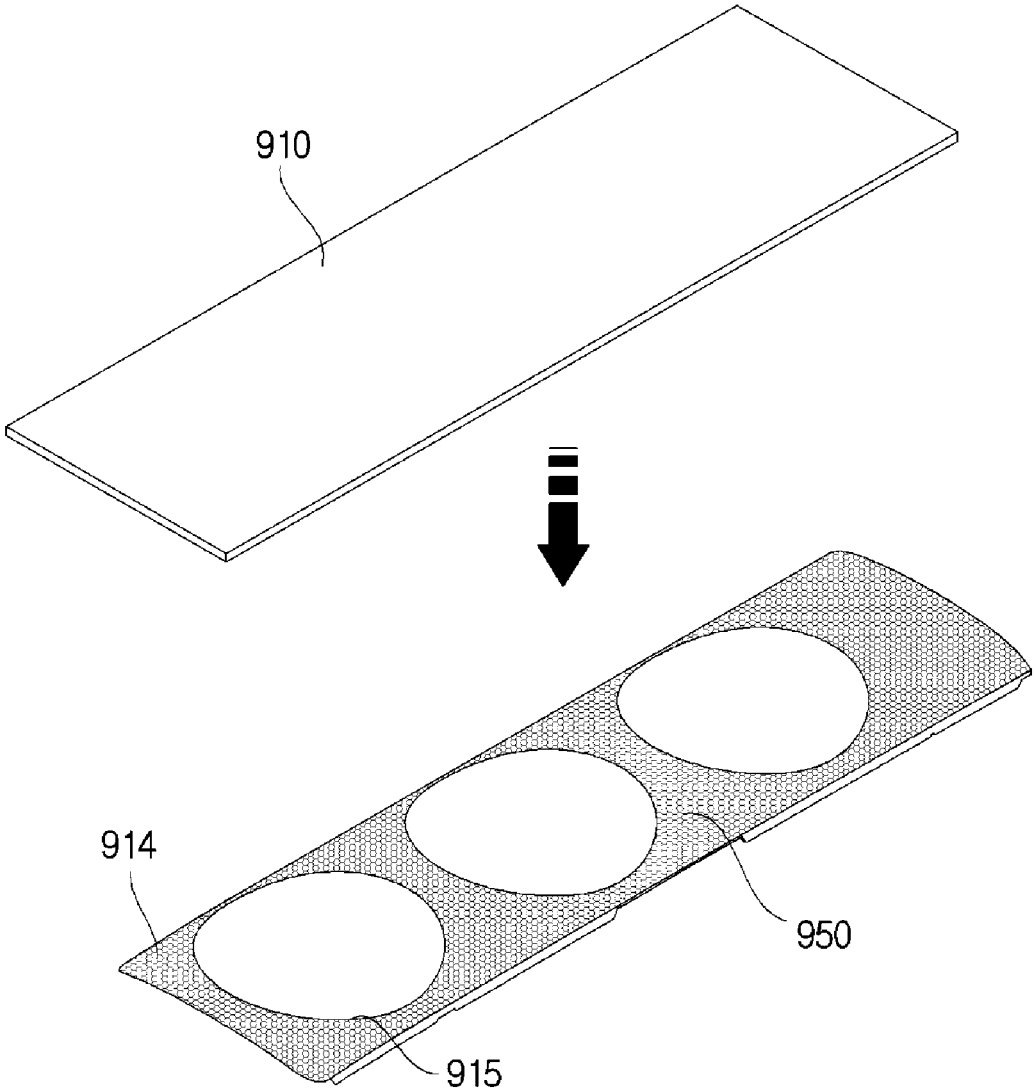
FIG. 12 shows a discharging plate, according to an embodiment of the present disclosure.

FIG. 12 shows a discharging plate 914, according to an embodiment of the present disclosure.

A second discharger 950 may be formed on a discharging plate 914.

The discharging plate 914 may be formed by a press forming process. The discharging plate 914 may be formed by performing a press forming process on a metal plate 910, and a second discharger 950 may be formed by a perforating process. The press forming process to form at least one opening 915 of the discharging plate 914 and the perforating process to form the second discharger 950 may be performed simultaneously or independently.

An AC in accordance with an embodiment of the present disclosure will now be described.

Arrangements overlapping with what are described above will be omitted herein.

Figure 13:
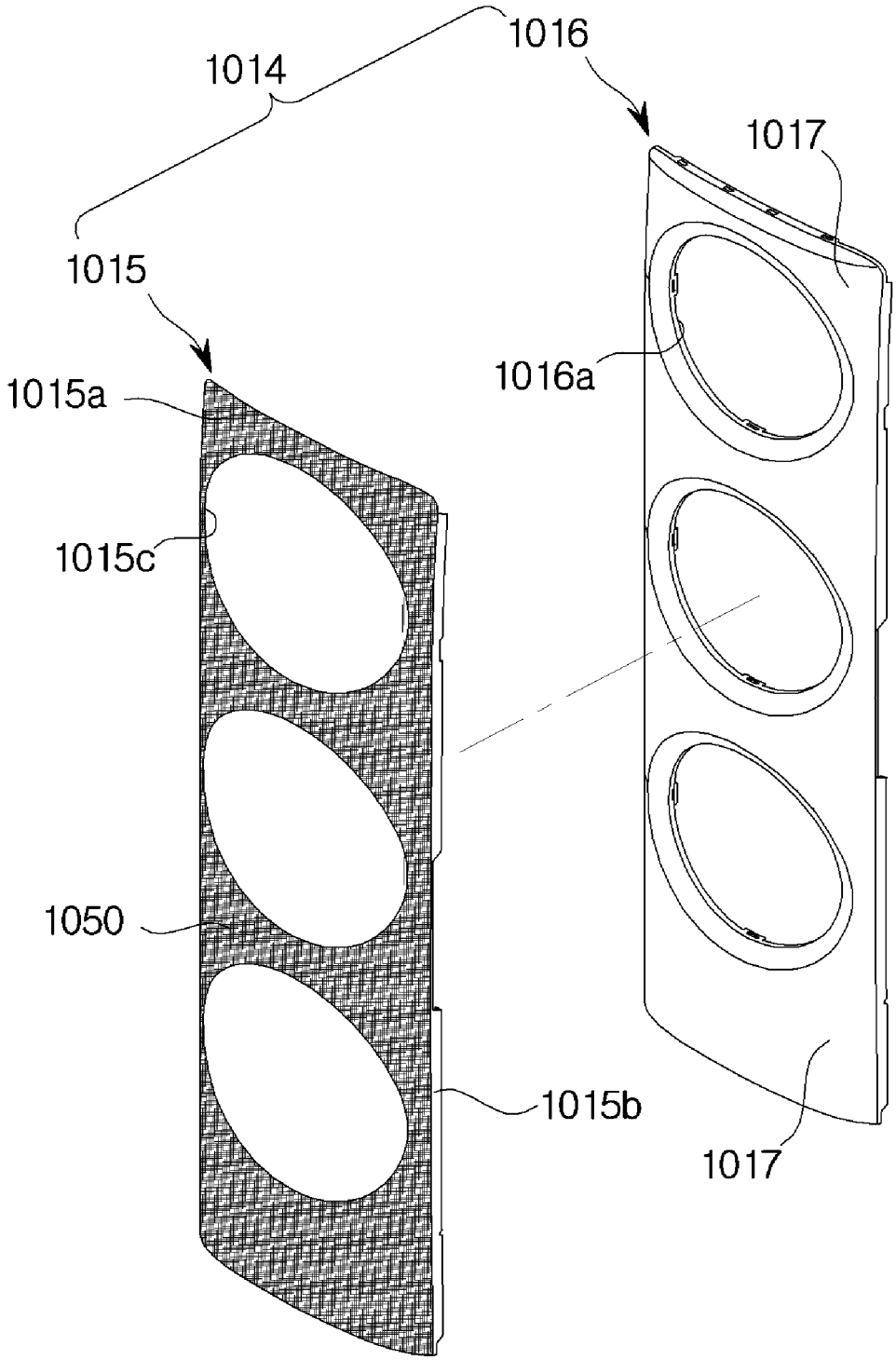
FIGS. 13 and 14 show a discharging plate, according to an embodiment of the present disclosure.
Figure 14:
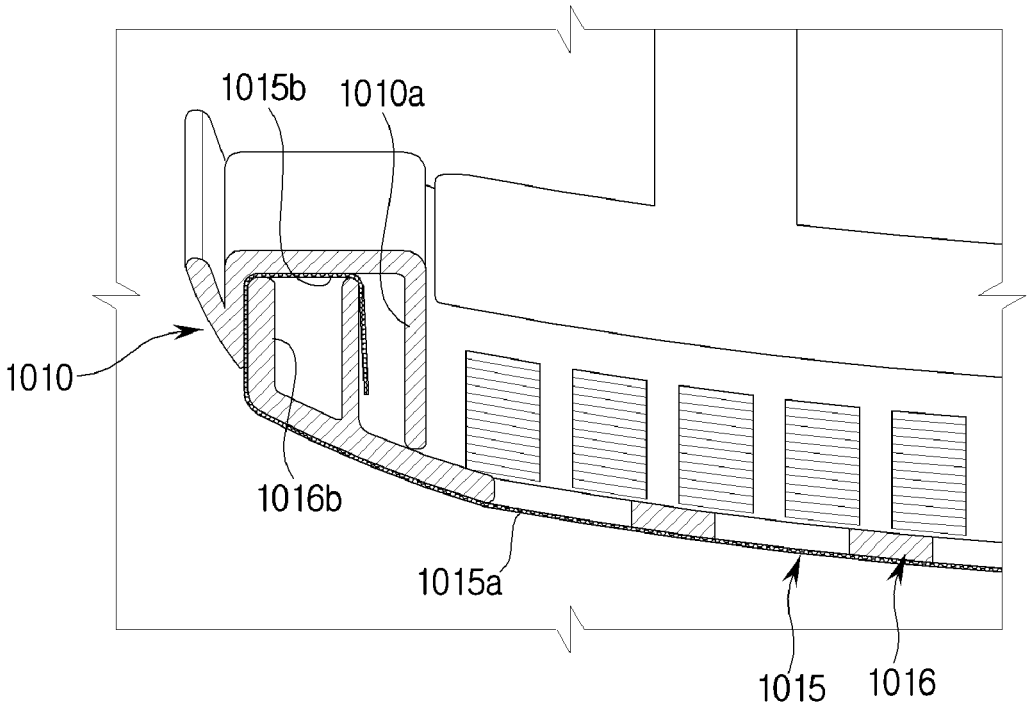

FIGS. 13 and 14 show a discharging plate, according to an embodiment of the present disclosure.

A discharging plate 1014 may include a discharging sheet 1015 and a support frame 1016.

A second discharger 1050 may be formed on the discharging sheet 1015. The second discharger 1050 may include a plurality of discharging holes. The second discharger 1050 may be formed on the discharging sheet 1015 by a perforating process.

The discharging sheet 1015 may be formed to be mounted on the front of the support frame 1016. The discharging sheet 1015 may be supported by the support frame 1016 to avoid deformation.

The discharging sheet 1015 may include at least one sheet opening 1015*c*. The at least one sheet opening 1015*c* may have the form of an opening to correspond to the at least one first discharger 41.

The discharging sheet 1015 may be formed to be detachable from the support frame 1016 as will be described below. This enables the discharging sheet 1015 to be separated therefrom for cleaning, facilitating easy maintenance of the AC.

The support frame 1016 may include a plurality of supporters 1017.

The plurality of supporters 1017 are arranged to support the rear side of the discharging sheet 1015 to avoid the discharging sheet 1015 from being wrinkled but to keep it straight on the front of the support frame 1017. Because the discharging sheet 1015 is arranged as the exterior of the AC, it may prevent the user from getting hurt by the internal parts of the AC.

The support frame 1016 may include at least one frame opening 1016*a*. The at least one frame opening 1016*a* may have the form of an opening to correspond to the at least one first discharger 41. The discharging sheet 1015 and the support frame 1016 may be combined to match the frame opening 1016*a* and the sheet opening 1015*c*.

The discharging sheet 1015 may include a sheet body 1015*a*, and a sheet combiner 1015*b* arranged on both ends of the sheet body 1015*a*.

The second charger 1050 is formed on the sheet body 1015*a*. The sheet body 1015*a* and the second discharger 1050 may be arranged to form a shape of net. In other words, the sheet body 1015*a* may be formed to have the form of a net to form the second discharger 1050 for discharging air.

The sheet body 1015*a* is supported by the support frame 1016, and the sheet combiner 1015*b* is formed to be bendable from the sheet body 1015*a*. The sheet combiner 1015*b* may be put in between both ends of the support frame 1016 and the housing, as shown in FIG. 14.

Specifically, frame combining grooves 1010*a* corresponding to either end of the support frame 1016 are formed on the housing 1010, and frame projections 1016*b* corresponding to the frame combining grooves 1010*a* may be formed at either end of the support frame 1016. The sheet combiner 1015*b* may be arranged between the frame combining groove 1010*a* and the frame projection 1016*b* to put the support frame 1016 into the housing 1010, thereby enabling the discharging sheet 1015 to be fixed.

The material of the discharging sheet 1015 has no limitation, and in the embodiment of the present disclosure, the discharging sheet 1015 may be made of metal to enable the second discharger 1050 to be formed in a perforating process. It is not, however, limited thereto, and the discharging sheet 1050 may be formed to include at least one of fiber and film materials.

The discharging sheet 1050 formed to include at least one of fiber and film materials may prevent the user who uses the AC from being hurt and maintain the discharging sheet 1015 to be straight. This may enable the air to be easily discharged through the second discharger 1050 formed in the discharging sheet 1015.

The discharging sheet 1015 may be formed as a filter. As the discharging sheet 1015 is formed as a filter, more purified air may be discharged out of the AC through the discharging plate 1014.

An AC in accordance with an embodiment of the present disclosure will now be described.

Arrangements overlapping with what are described above will be omitted herein.

Figure 15:
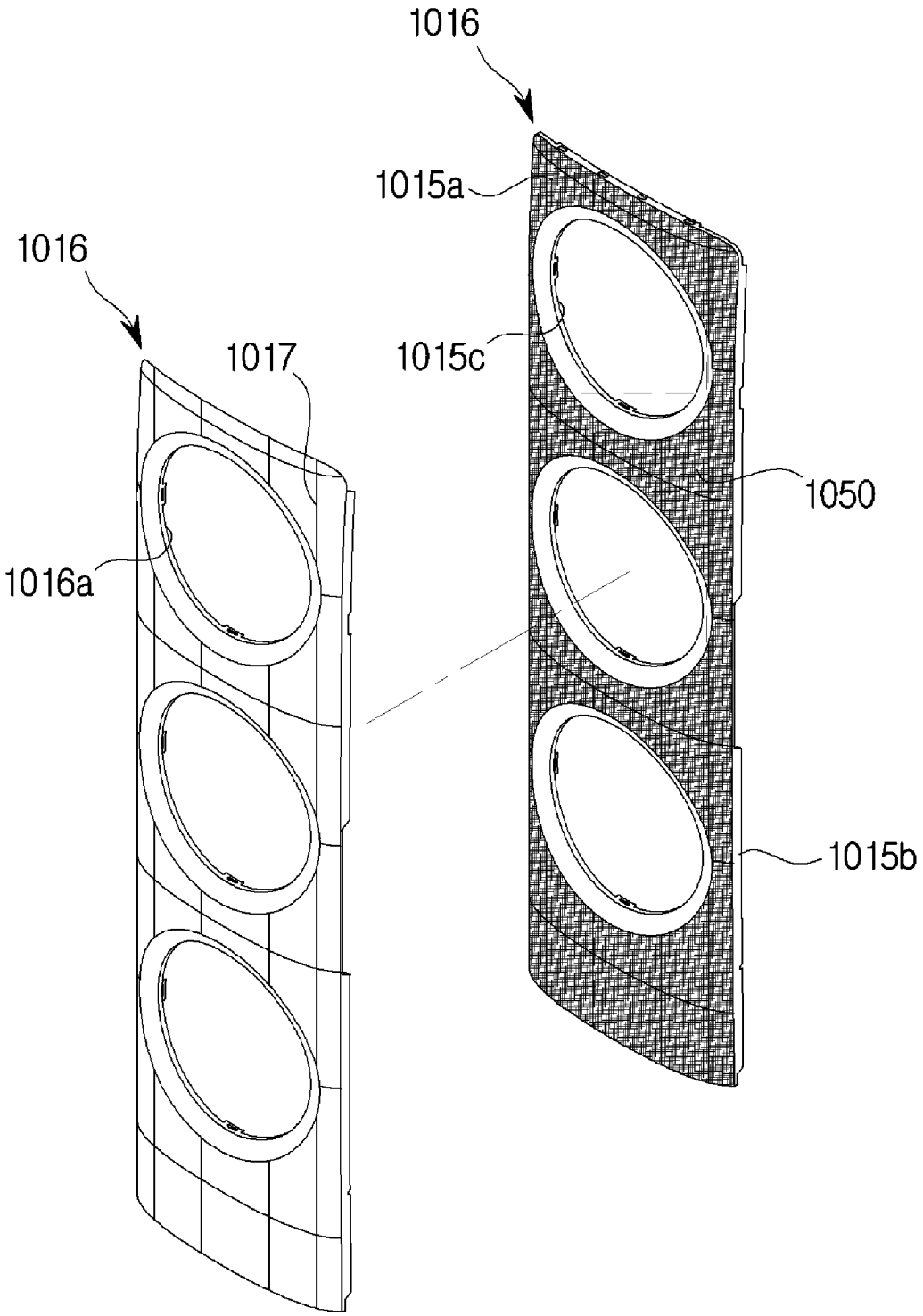
FIG. 15 shows a discharging plate, according to an embodiment of the present disclosure.

FIG. 15 shows a discharging plate, according to an embodiment of the present disclosure.

A discharging plate 1014 may include a discharging sheet 1015 and a support frame 1016. The discharging sheet 1015 may be arranged on the back of the support frame 1016 in the present embodiment. In this case, the support frame 1016 may protect the discharging sheet 1015 to be less influenced by the surrounding condition and prevent it from being damaged.

An AC in accordance with an embodiment of the present disclosure will now be described.

Arrangements overlapping with what are described above will be omitted herein.

Figure 16:
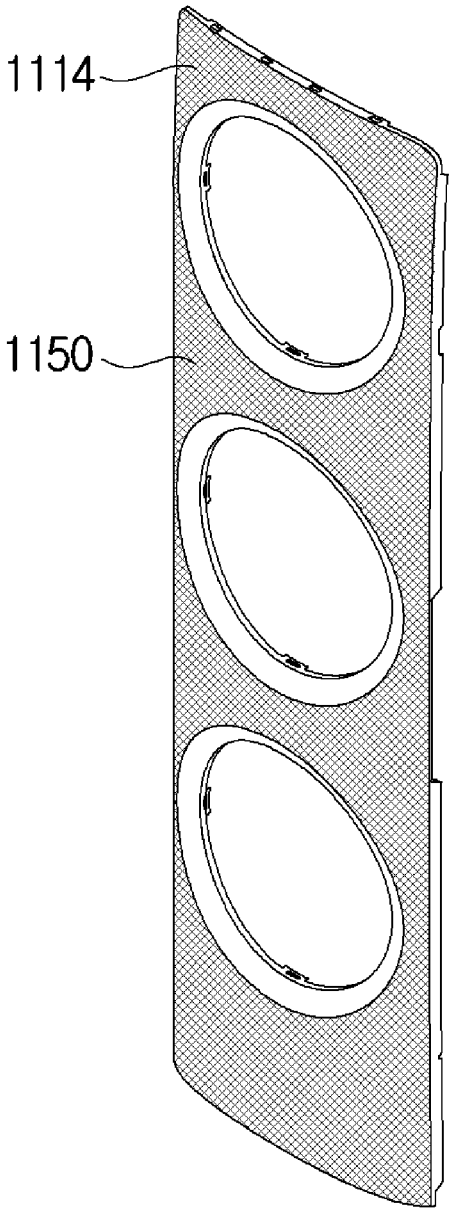
FIG. 16 shows a discharging plate, according to an embodiment of the present disclosure.

FIG. 16 shows a discharging plate, according to an embodiment of the present disclosure.

A second discharger 1150 may be formed on a discharging plate 1114.

The discharging plate 1114 and the second discharger 1150 may be formed by injection molding. Because the discharging plate 1114 and the second discharger 1150 may be simultaneously formed by the injection molding, the discharging plate 1114 may be easily manufactured.

An AC in accordance with an embodiment of the present disclosure will now be described.

Arrangements overlapping with what are described above will be omitted herein.

Figure 17:
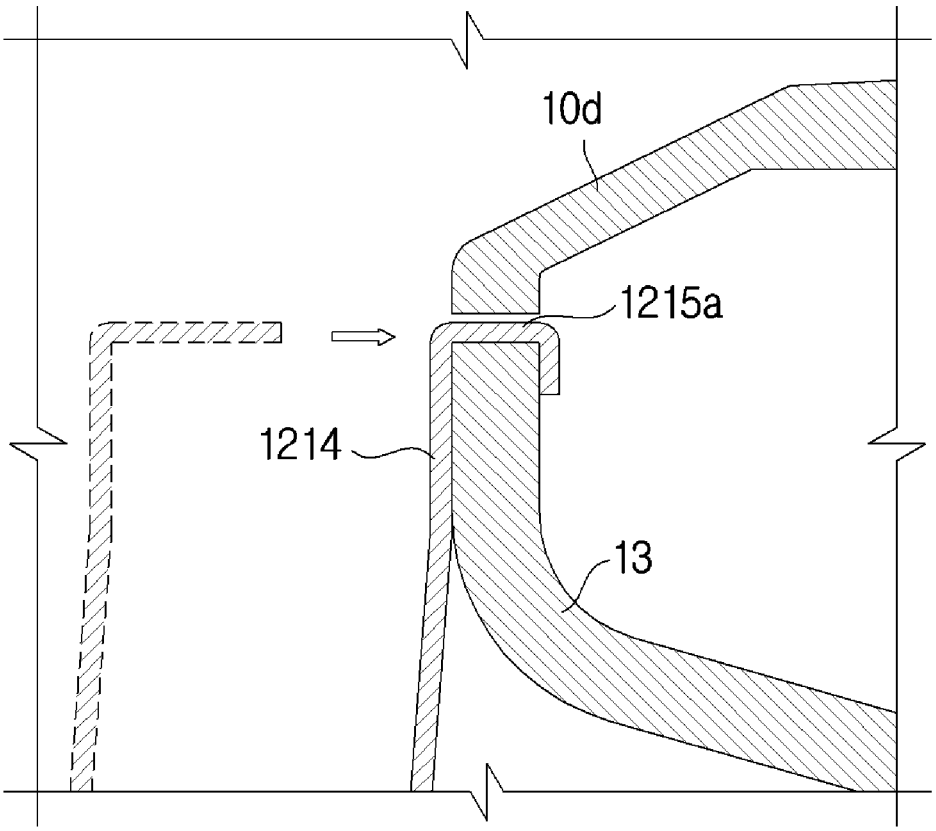
FIG. 17 shows combination of a discharging plate and a housing, according to an embodiment of the present disclosure.
Figure 18:
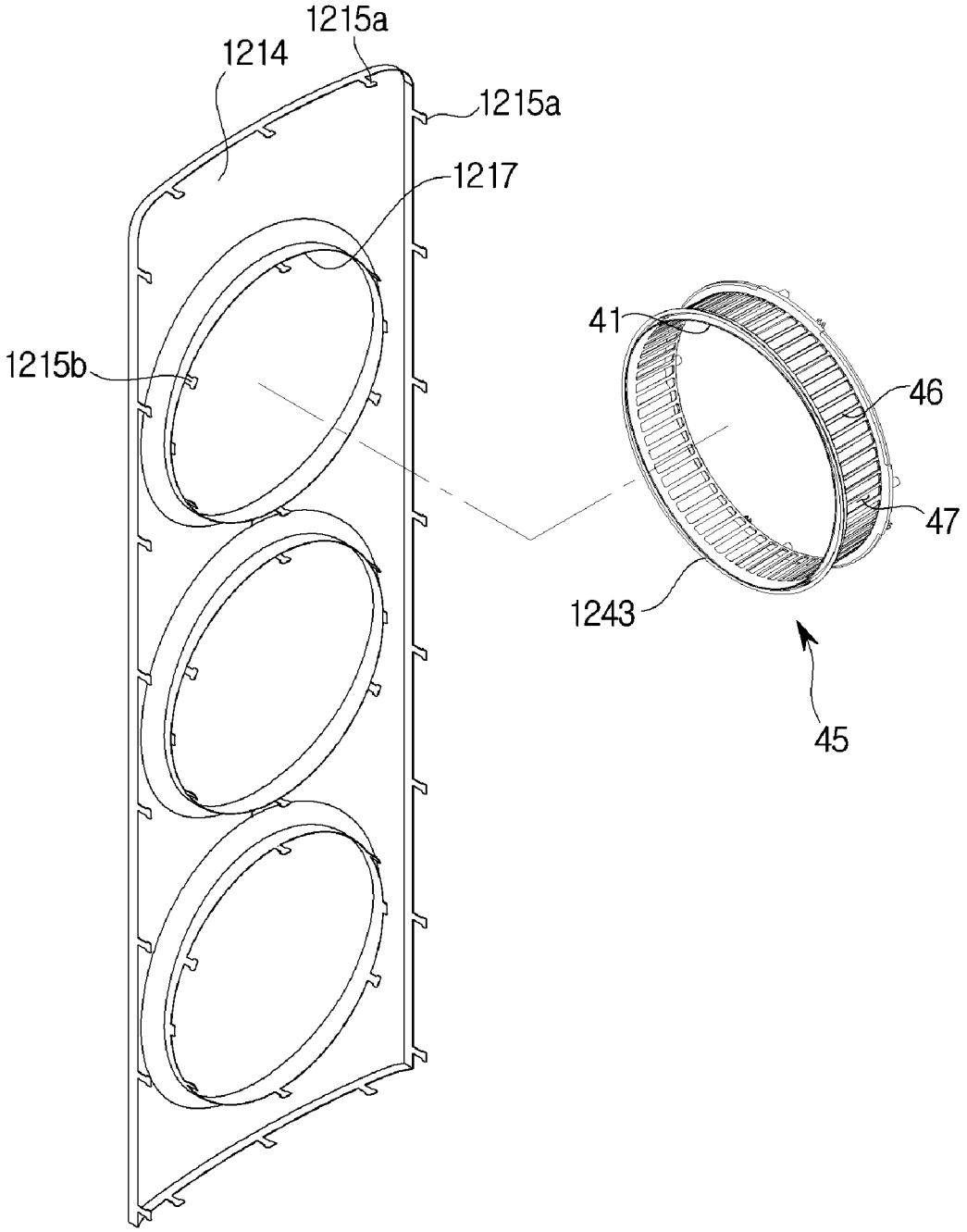
FIGS. 18, 19, and 20 show combination of a discharging plate and a guide opening, according to an embodiment of the present disclosure.
Figure 19:
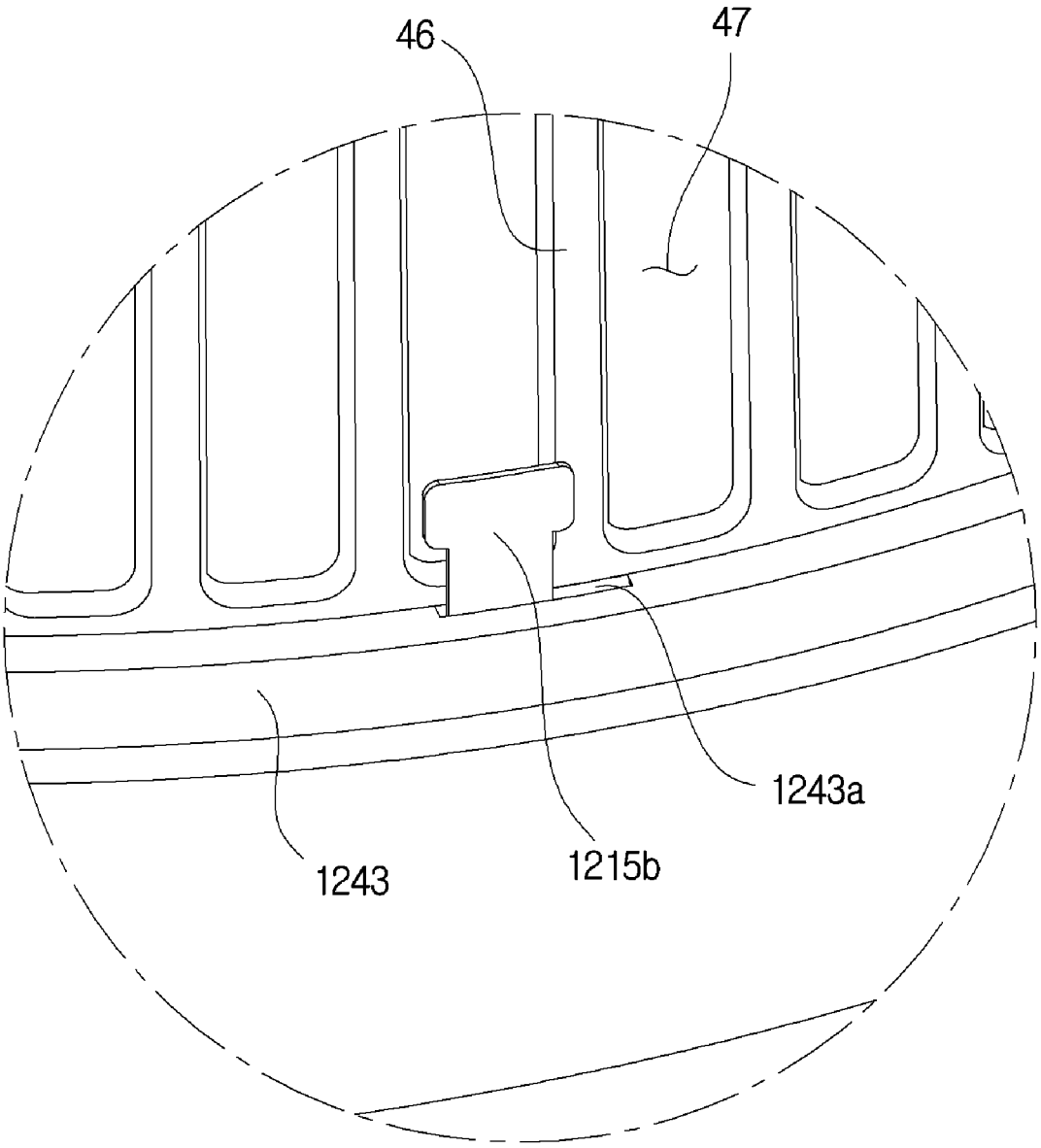
Figure 20:
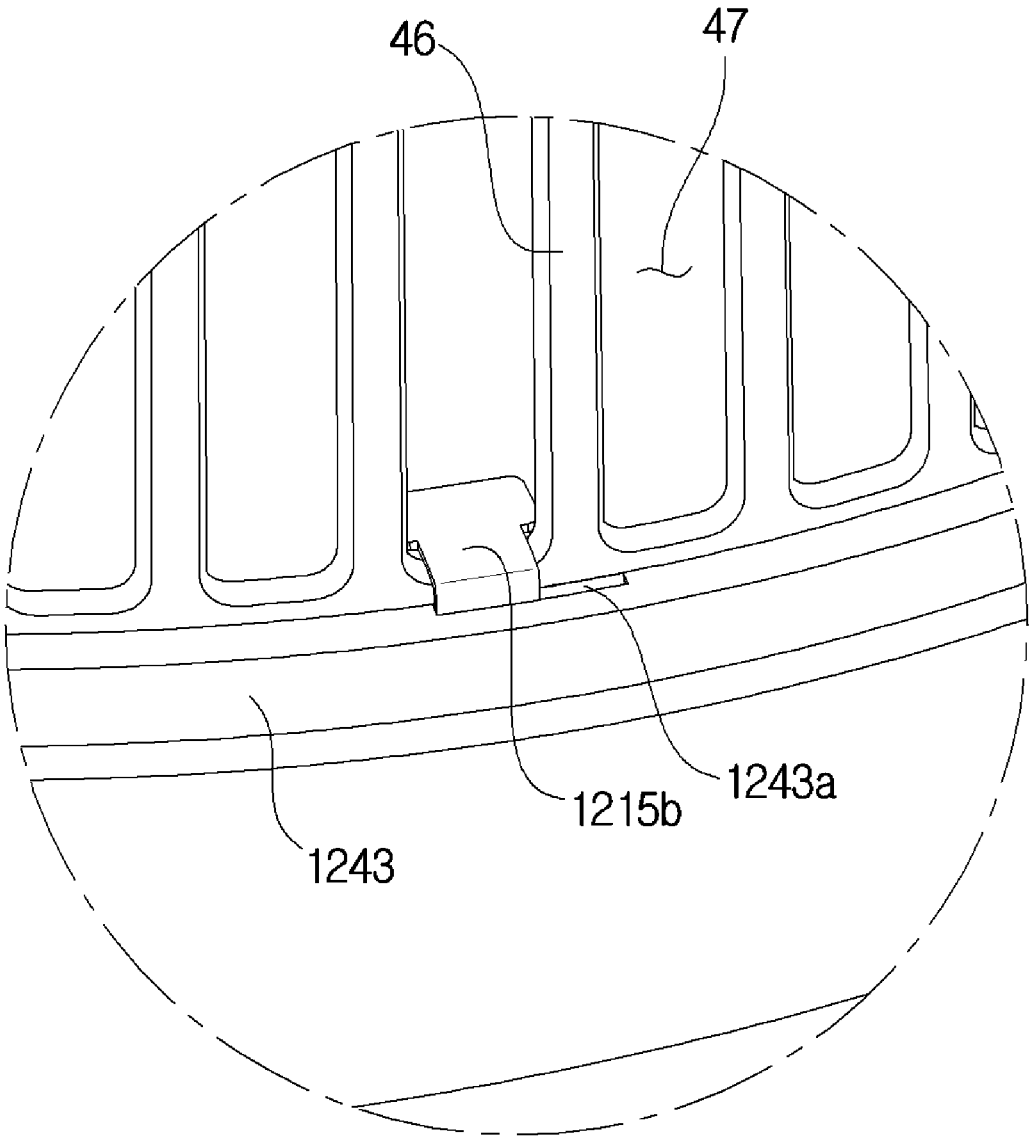

FIG. 17 shows a combination of a discharging plate and a housing, according to an embodiment of the present disclosure, and FIGS. 18, 19, and 20 show a combination of a discharging plate and a guide opening, according to an embodiment of the present disclosure.

A discharging plate 1214 may include plate combiners 1215*a*, 1215*b*. The plate combiners 1215*a*, 1215*b* may be formed to combine the discharging plate 1214 with the housing 10 or a guide opening 1243.

The plate combiners 1215*a*, 1215*b* may be formed along the contour of the discharging plate 1214 for combination with the housing 10. The plate combiners 1215*a*, 1215*b* may be formed along the contour of the opening 1217 of the discharging plate 1214 for combination with the guide opening 1243.

The plate combiners 1215*a*, 1215*b* may be formed to protrude from the discharging plate 1214. The plate combiners 1215*a*, 1215*b* may be bendable to be combined with the housing 10 or the guide opening 1243.

The plate combiners 1215*a*, 1215*b* may include the first plate combiner 1215*a* to combine the discharging plate 1214 with the housing 10, and the second plate combiner 1215*b* to combine the discharging plate 1214 with the guide opening 1243.

At least one first plate combiner 1215*a* may be arranged along the contour of the discharging plate 1214. The first plate combiner 1215*a* is combined with the housing 10 to combine the housing 10 and the discharging plate 1214.

After the discharging plate 1214 closely contacts the housing 10 as shown in FIG. 17, the first plate combiner 1215*a* is bent for the discharging plate 1214 not to fall out of the housing 10. In the embodiment, for example, the first plate combiner 1215*a* is formed to be bent to cover a side of the fluid path shaping frame 13, without being limited thereto. The first plate combiner 1215*a* may be bent in various ways as long as the bending enables the discharging plate 1214 to be combined with the housing 10. There is no limitation on the number of the first plate combiners 1215*a*.

At least one second plate combiner 1215*b* may be arranged along the contour of the opening 1217, as shown in FIG. 18. The second plate combiner 1215*b* is combined with the guide opening 1243 to combine the guide opening 1243 and the discharging plate 1214.

A guide insertion groove 1243*a* may be formed in the guide opening 1243 for the second plate combiner 1215*b* to be inserted thereto. When the discharging plate 1214 and the guide opening 1243 have close contact with each other, the second plate combiner 1215*b* may be inserted through the guide insertion groove 1243*a*, passing through the guide opening 1243. The guide insertion groove 1243*a* may be arranged along the circumference of the guide opening 1243 to correspond to the second plate combiner 1215*b* arranged on the outer edge of the opening.

Once the second plate combiner 1215*b* may be put into the guide insertion groove 1243*a*, the guide opening 1243 and the discharging plate 1214 may be combined by bending the second plate combiner 1215*b* to be caught by the guide opening 1243.

There is no limitation on the number of the second plate combiners 1215*b* and guide insertion grooves 1243*a*.

An AC in accordance with an embodiment of the present disclosure will now be described.

Arrangements overlapping with what are described above will be omitted herein.

Figure 21:
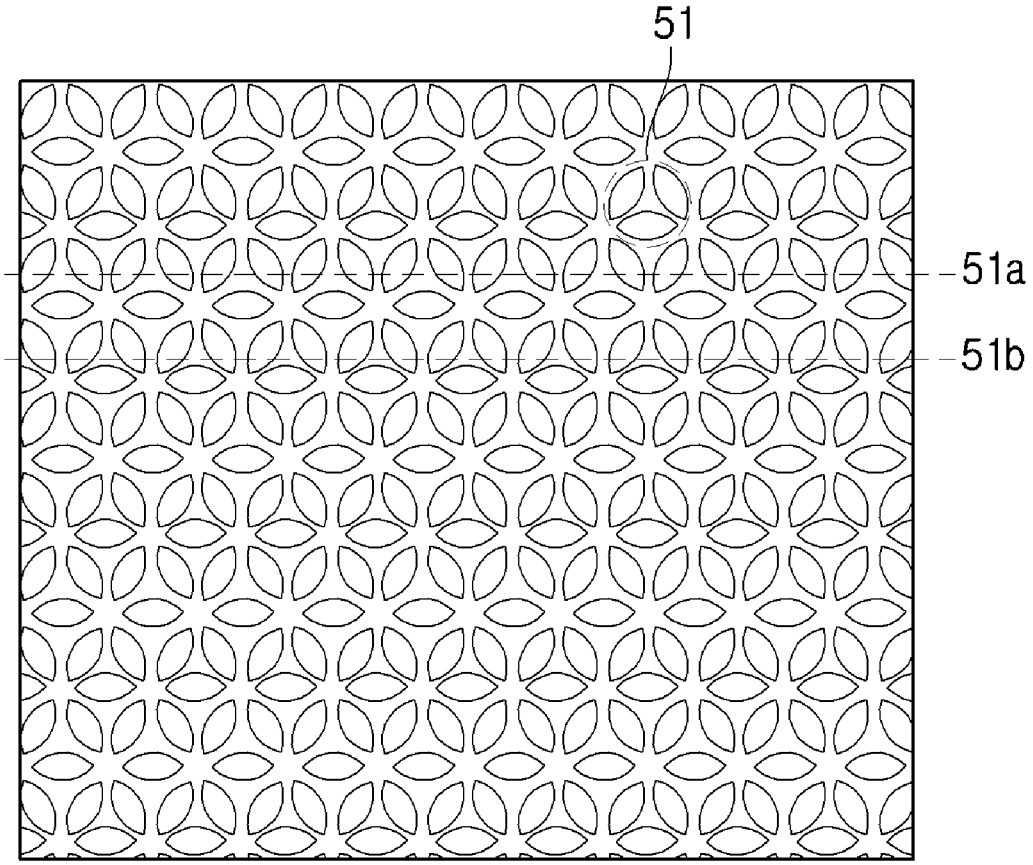
FIG. 21 is an enlarged view of a second discharger, according to an embodiment of the present disclosure.

FIG. 21 is an enlarged view of a second discharger, according to an embodiment of the present disclosure.

In the embodiment, the pattern of the second discharger 50 will be described. For convenience of explanation, the second discharger 50 formed on the discharging plate is enlarged.

The second discharger 50 may include a plurality of discharging patterns 51.

The plurality of discharging patterns 51 are formed as round holes bored through the inner and outer sides of the discharging plate 14, with a plurality of ribs formed radially from the center of the round hole to partition the inside of the round hole. There is no limitation on how to arrange the plurality of ribs, but in the embodiment, three ribs are arranged at intervals of 120 degrees, dividing the inside of the round hole into three.

The plurality of discharging patterns 51 may include a first array of discharging patterns 51*a* and a second array of discharging patterns 51*b* arranged in parallel with the first array. There is no limitation on the gap between the first and second arrays, and there is no limitation on the gap between the neighboring discharging patterns in each array. Although the first and second arrays are horizontally arranged in FIG. 21, they may be arranged vertically in an embodiment.

In the present embodiment, the discharging patterns 51 in the first and second arrays may be arranged alternately. It is not, however, limited thereto, but it is also possible for the discharging patterns in the first and second arrays 51*a* and 51*b* to be arranged in parallel.

An AC in accordance with an embodiment of the present disclosure will now be described.

Arrangements overlapping with what are described above will be omitted herein.

Figure 22:
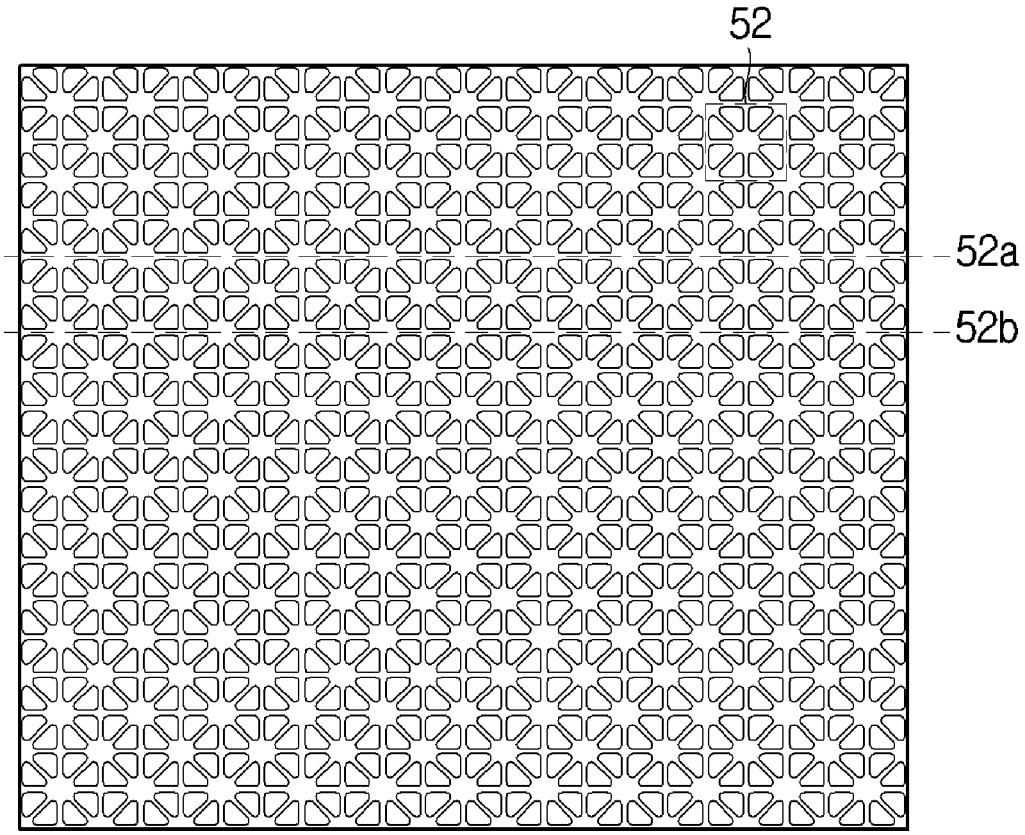
FIG. 22 is an enlarged view of a second discharger, according to an embodiment of the present disclosure.

FIG. 22 is an enlarged view of a second discharger, according to an embodiment of the present disclosure.

In the embodiment, the pattern of the second discharger 50 will be described. For convenience of explanation, the second discharger 50 formed on the discharging plate 14 is enlarged.

The second discharger 50 may include a plurality of discharging patterns 52.

The plurality of discharging patterns 52 are formed as square holes bored through the inner and outer sides of the discharging plate 14, with a plurality of ribs formed radially from the center of the square hole to partition the inside of the square hole. There is no limitation on how to arrange the plurality of ribs, but in the embodiment, eight ribs are arranged at intervals of 45 degrees, dividing the inside of the square hole into eight.

The plurality of discharging patterns 52 may include a first array of discharging patterns 52*a* and a second array of discharging patterns 52*b* arranged in parallel with the first array. There is no limitation on the gap between the first and second arrays, and there is no limitation on the gap between the neighboring discharging patterns 52 in each array. Although the first and second arrays are horizontally arranged in FIG. 22, they may be arranged vertically in an embodiment.

In the present embodiment, the discharging patterns 52 in the first and second arrays may be arranged in parallel. It is not, however, limited thereto, but it is also possible for the discharging patterns in the first and second arrays 52*a* and 52*b* to be arranged alternately.

An AC in accordance with an embodiment of the present disclosure will now be described.

Arrangements overlapping with what are described above will be omitted herein.

Figure 23:
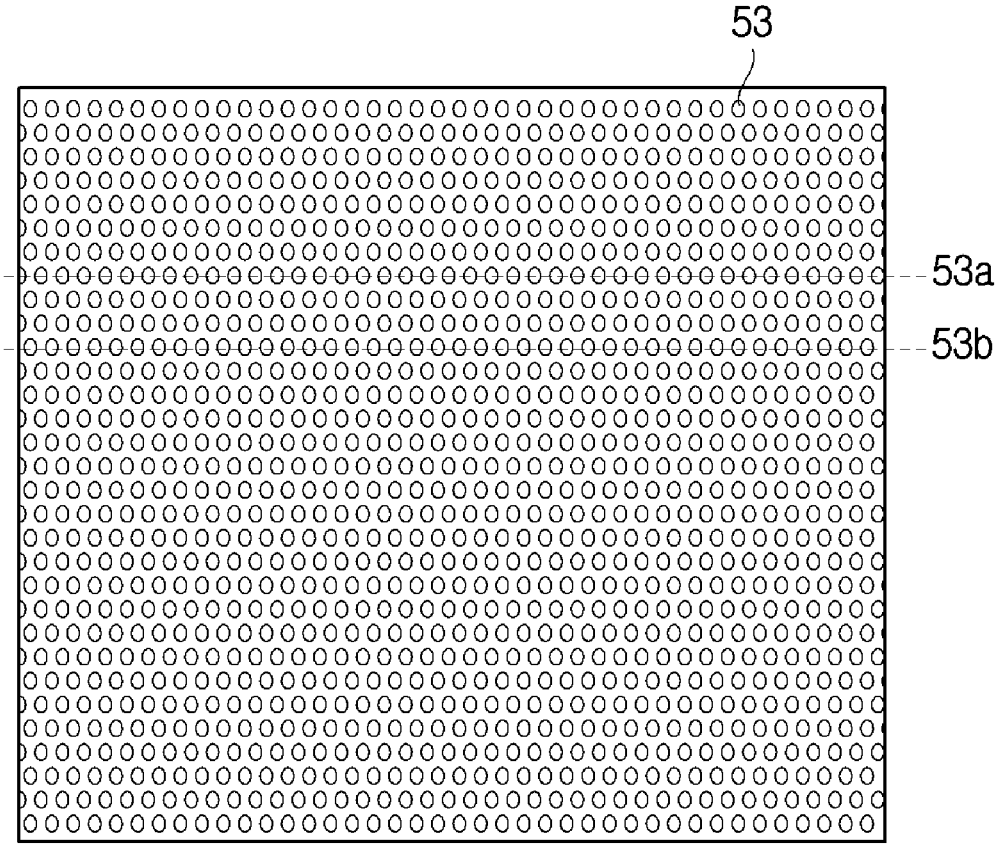
FIG. 23 is an enlarged view of a second discharger, according to an embodiment of the present disclosure.
Figure 24:
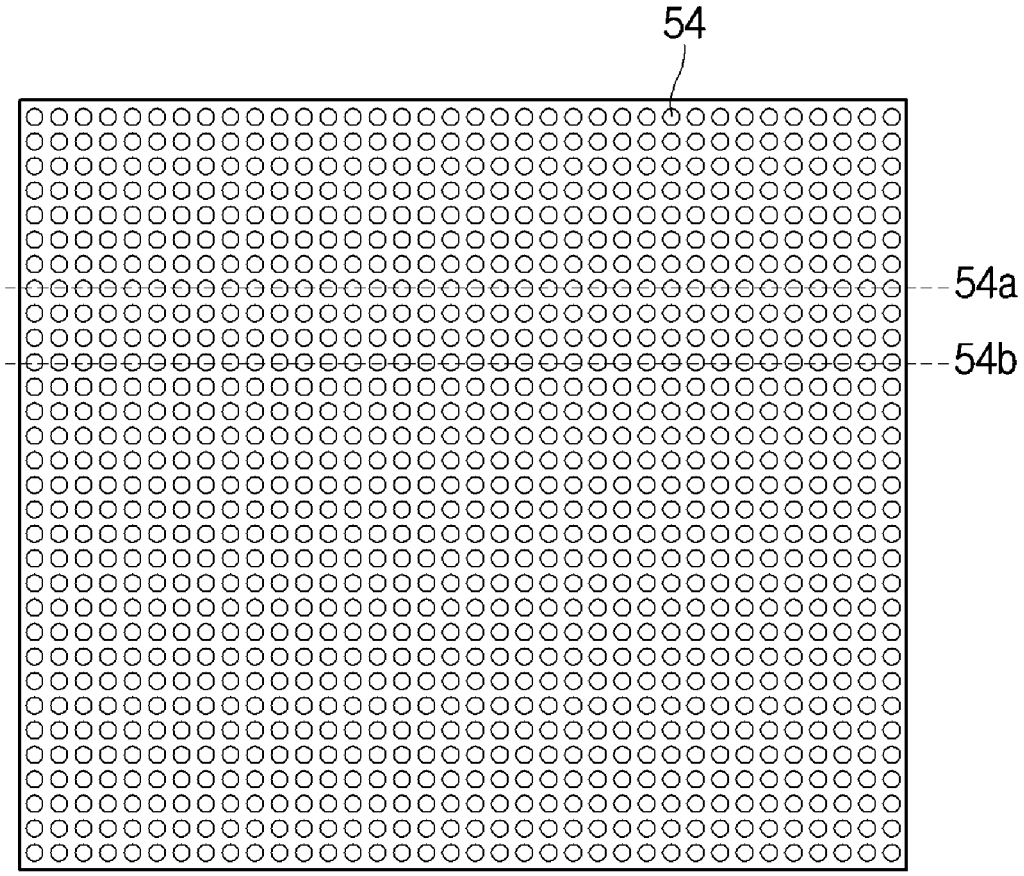
FIG. 24 is an enlarged view of a second discharger, according to an embodiment of the present disclosure.

FIG. 23 is an enlarged view of a second discharger, according to an embodiment of the present disclosure, and FIG. 24 is an enlarged view of a second discharger, according to an embodiment of the present disclosure.

In the embodiments, patterns of the second discharger 50 will be described. For convenience of explanation, the second discharger 50 formed on the discharging plate 14 is enlarged.

The second discharger 50 may include a plurality of discharging patterns 53.

The plurality of discharging patterns 53 may be formed as round holes bored through the inner and outer sides of the discharging plate 14.

The plurality of discharging patterns 53 may include a first array of discharging patterns 53*a* and a second array of discharging patterns 53*b* arranged in parallel with the first array. There is no limitation on the gap between the first and second arrays, and there is no limitation on the gap between the neighboring discharging patterns 53 in each array. Although the first and second arrays are horizontally arranged in FIG. 23, they may be arranged vertically in an embodiment.

As shown in FIG. 23, the discharging patterns 53*a*, 53*b* in the first and second arrays may be arranged alternately. It is not, however, limited thereto, but it is also possible for the discharging patterns 54 in the first and second arrays 54*a* and 54*b* to be arranged in parallel as shown in FIG. 24.

An AC in accordance with an embodiment of the present disclosure will now be described.

Arrangements overlapping with what are described above will be omitted herein.

Figure 25:
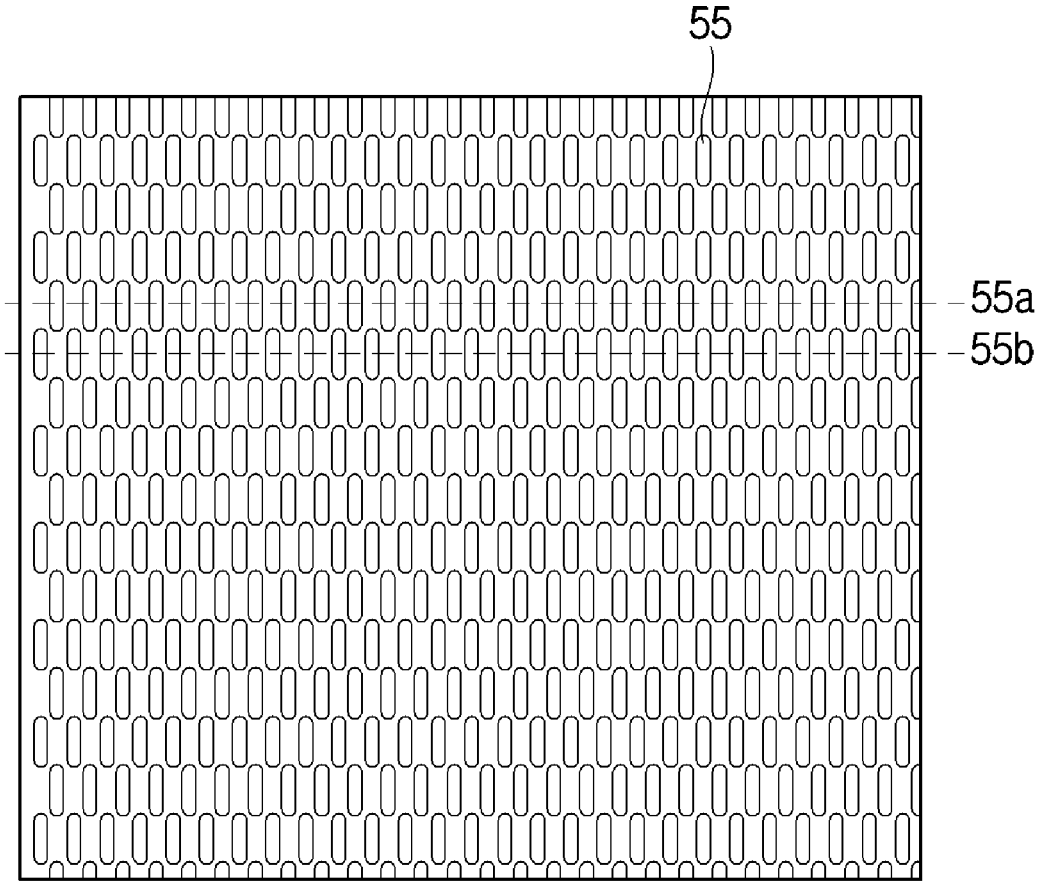
FIG. 25 is an enlarged view of a second discharger, according to an embodiment of the present disclosure.

FIG. 25 is an enlarged view of a second discharger, according to an embodiment of the present disclosure.

In the embodiments, patterns of the second discharger 50 will be described. For convenience of explanation, the second discharger 50 formed on the discharging plate 14 is enlarged.

The second discharger 50 may include a plurality of discharging patterns 55.

The plurality of discharging patterns 55 may be formed as linear holes bored through the inner and outer sides of the discharging plate 14. The linear hole is arranged such that the longitudinal direction of the linear hole corresponds to the vertical direction.

The plurality of discharging patterns 55 may include a first array of discharging patterns 55*a* and a second array of discharging patterns 55*b* arranged in parallel with the first array. There is no limitation on the gap between the first and second arrays, and there is no limitation on the gap between the neighboring discharging patterns 55 in each array. Although the first and second arrays are horizontally arranged in FIG. 23, they may be arranged vertically in an embodiment.

In the present embodiment, the discharging patterns 55 in the first and second arrays may be arranged alternately. It is not, however, limited thereto, but it is also possible for the discharging patterns 55 in the first and second arrays 55*a* and 55*b* to be arranged in parallel.

An AC in accordance with an embodiment of the present disclosure will now be described.

Arrangements overlapping with what are described above will be omitted herein.

Figure 26:
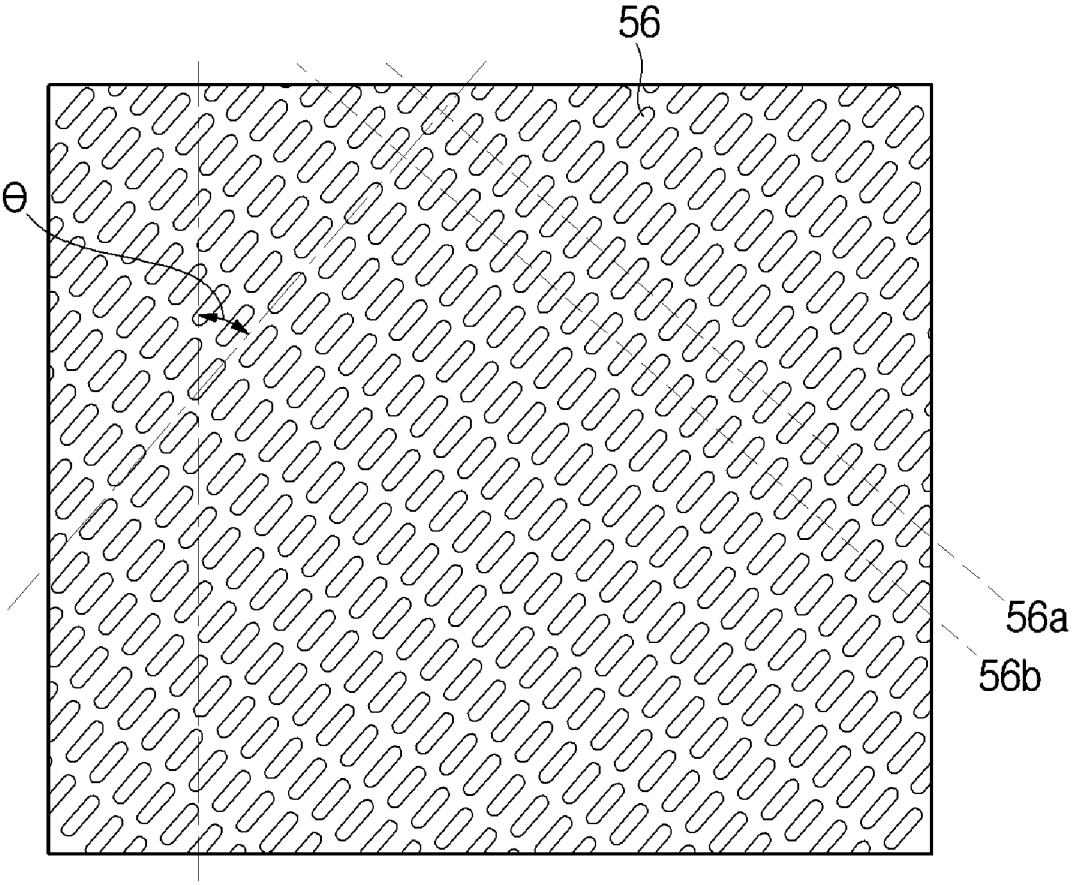
FIG. 26 is an enlarged view of a second discharger, according to an embodiment of the present disclosure.

FIG. 26 is an enlarged view of a second discharger, according to an embodiment of the present disclosure.

In the embodiment, patterns of the second discharger 50 will be described. For convenience of explanation, the second discharger 50 formed on the discharging plate 14 is enlarged.

The second discharger 50 may include a plurality of discharging patterns 56.

In the embodiment of FIG. 25, linear holes are arranged vertically.

In the present embodiment, the linear holes may be arranged to be slanted at a predetermined angle.

Specifically, they may be arranged to be slanted at a predetermined angle from the vertical direction. The predetermined angle Θ may range from 0 to 90 degrees.

The plurality of discharging patterns 56 may include a first array of discharging patterns 56*a* and a second array of discharging patterns 56*b* arranged in parallel with the first array. There is no limitation on the gap between the first and second arrays, and there is no limitation on the gap between the neighboring discharging patterns 56 in each array.

The first and second arrays are oblique arrays slanted at the predetermined angle Θ from the vertical direction, without being limited thereto.

In the present embodiment, the discharging patterns 56 in the first and second arrays may be arranged alternately. It is not, however, limited thereto, but it is also possible for the discharging patterns in the first and second arrays 56*a* and 56*b* to be arranged in parallel.

An AC in accordance with an embodiment of the present disclosure will now be described.

Arrangements overlapping with what are described above will be omitted herein.

Figure 27:
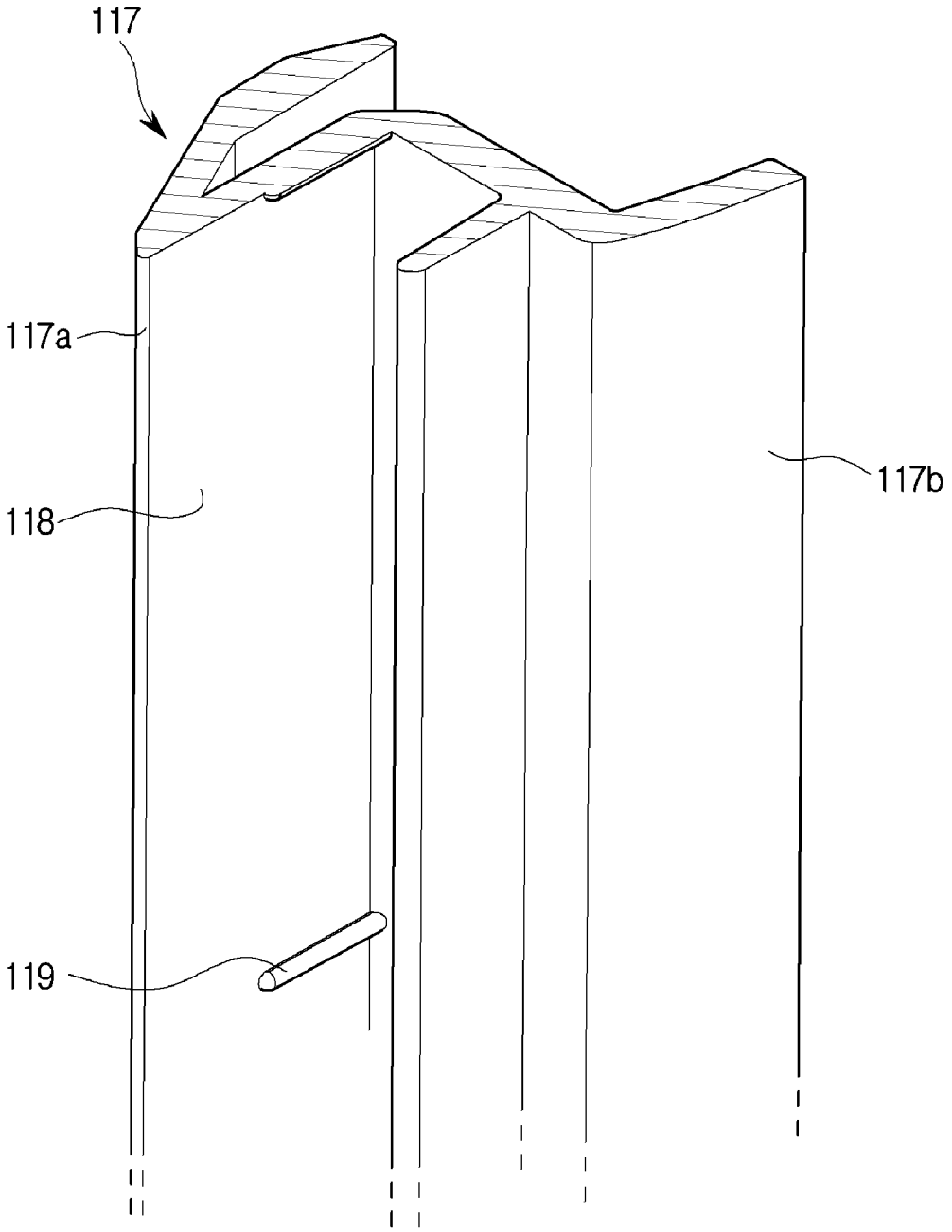
FIG. 27 is a partially enlarged view of a combining guide, according to an embodiment of the present disclosure.
Figure 28:
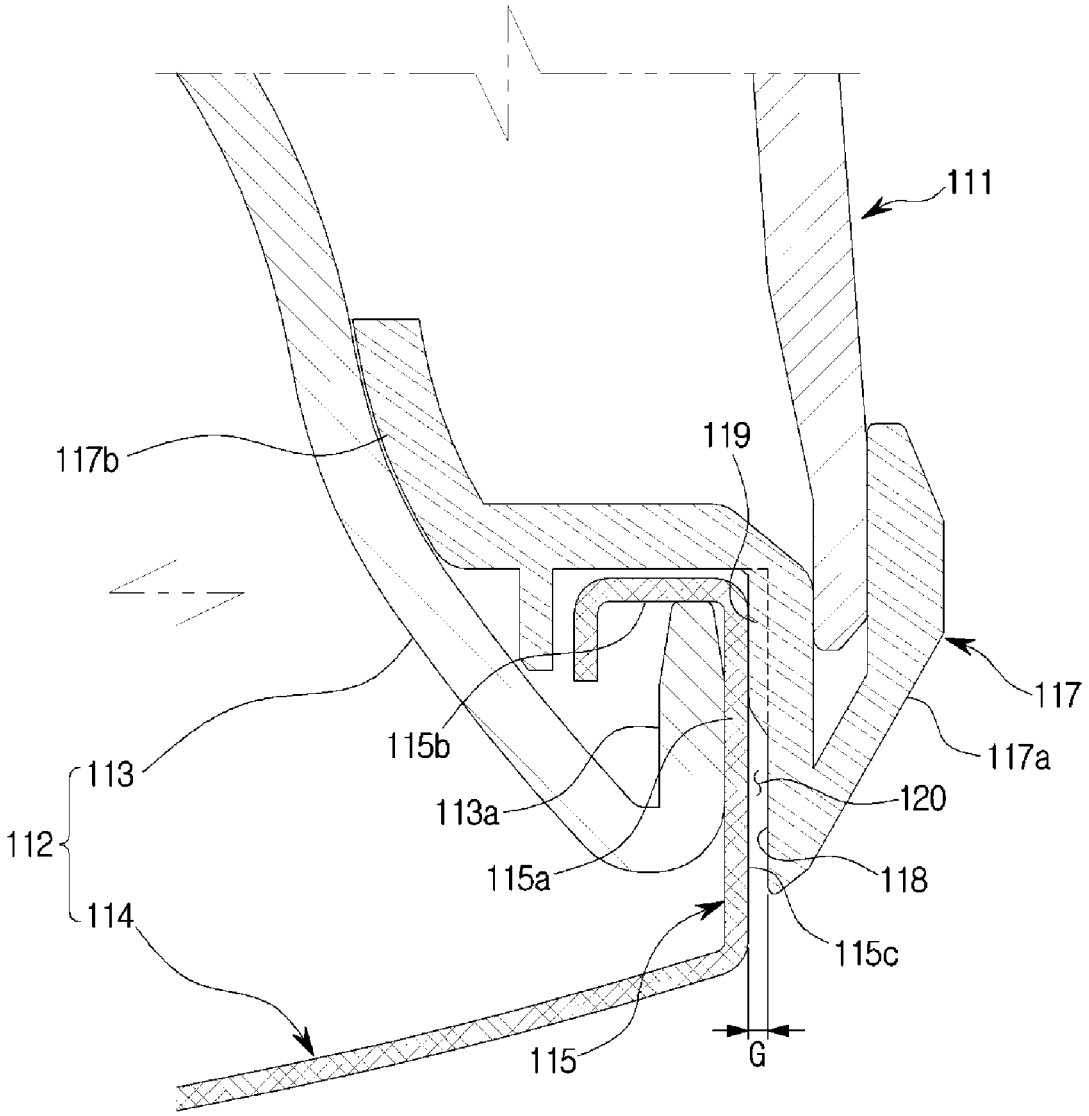
FIG. 28 is a cross-sectional view of combination of an exterior panel and a discharging panel, according to an embodiment of the present disclosure.

FIG. 27 is a partially enlarged view of a combining guide, according to an embodiment of the present disclosure, and FIG. 28 is a cross-sectional view of combination of an exterior panel and a discharging panel, according to an embodiment of the present disclosure. FIG. 27 is an embodiment of a section corresponding to 'B' of FIG. 2, and FIG. 28 is an embodiment of a section corresponding to 'C' of FIG. 9.

The housing 10 may include an exterior panel 111 forming the exterior and a discharging panel 112 arranged to discharge the heat exchanged air. The discharging panel 112 may be part of the external panel, or may be part of the discharger. The exterior panel 111 may form a panel opening 111*a* (see FIG. 2) with the front open, and the discharging panel 112 may be placed in the panel opening 111*a* for enabling the heat exchanged air to be discharged out of the AC through the discharging panel 112.

The discharging panel 112 may include a fluid path shaping frame 113 and the discharging plate 114.

The fluid path shaping frame 113 is located in the back of the discharging plate 114 for guiding the air that has exchanged heat by the heat exchanger to the discharging plate 114.

The discharging plate 114 may be formed to discharge the heat exchanged air to the outside. The discharging plate 114 may be formed to create a gap G from the inner side of the exterior panel 111 facing at least some portion of the circumference of the discharging plate 114. The gap G may be created outside a side wall of the discharging plate 114. Specifically, the exterior panel 111 includes a facing face 118 set up against the discharging plate 114, and the facing face 118 is formed to create the gap G with the discharging plate 114. The gap G is created between the exterior panel 111 and the discharging plate 114 may prevent the discharging plate 114 from coming into contact with the exterior panel 111 on a side. The width of the gap G has no limitation, and may depend on types of the AC.

The heat exchanged air may change in temperature while passing the discharging plate 114. In this case, because the discharging plate 114 is formed not to come into direct contact with the exterior panel 111 on a side, direct heat conduction may be prevented between the discharging plate 114 and the exterior panel 111. It may also prevent condensation buildup on the exterior panel 111 and improve heat efficiency.

The discharging plate 114 may include a plate flange 115.

The plate flange 115 may be formed on at least a portion of the circumference of the discharging plate 114. The plate flange 115 is formed to fix the discharging plate 114 to the AC. The plate flange 115 may be formed to be bent from the circumference of the discharging plate 114. With this structure, the plate flange 115 may enclose the circumference of the fluid path shaping frame 113. The plate flange 115 is arranged between the fluid path shaping frame 113 and the exterior panel 111 for fixing the discharging plate to the AC. Although in the present embodiment, the plate flange 115 is formed along the left, right, and top edges of the discharging plate 114, it may be formed on only one side or along the entire circumference of the discharging plate 114.

The plate flange 115 may include a flange body 115*a* and a flange fixer 115*b* extending and bending from the flange body 115*a*. The flange body 115*a* is located between the fluid path shaping frame 113 and the exterior panel 111. One side of the flange body 115*a* faces the facing face 118 of the exterior panel 111 with the gap G. The flange fixer 115*b* may be bent at least one time, and formed to join the cross-section of the fluid path shaping frame 113 on the inner side, catching the discharging plate 114 to preventing it from falling out and moving forward.

The exterior panel 111 may include the combining guide 117. The combining guide 117 is formed to fix the fluid path shaping frame 113 to the exterior panel 111. The combining guide 117 may be integrally formed with the exterior panel 111, but in the embodiment, it is formed separately from the exterior panel 111. The facing face 118 of the exterior panel 111 may be formed on the combining guide 117.

The combining guide 117 may include a panel combiner 117*a* and a frame combiner 117*b*. The panel combiner 117*a* is arranged on one side of the combining guide 117 to be combined with the exterior panel 111, and the frame combiner 117*b* is arranged on the other side of the combining guide 117 to be combined with the fluid path shaping frame 113. The facing face 118 may be formed on the inner side of the panel combiner 117*a*. There is no limitation on how to combine the panel combiner 117*a* and the frame combiner 117*b* with the exterior panel 111 and the fluid path shaping frame 113, respectively. For example, they may be combined by fitting or screwing.

In combining the combining guide 117 of the exterior panel 111 and the fluid path shaping frame 113, an insertion groove 120 may be formed between the combining guide 117 and the fluid path shaping frame 113 for the discharging plate 114 to be inserted thereto. The plate flange 115 of the discharging plate 114 is inserted to the insertion groove 120. Specifically, the fluid path shaping frame 113 may include a frame flange 113*a* formed along the circumference of the fluid path shaping frame 113, and the insertion groove 120 may be formed between the frame flange 113*a* and the facing face 118 of the combining guide 117.

The combining guide 117 may include a separation member 119.

The separation member 119 is arranged to separate the plate flange 115 and the facing face 118 of the combining guide 117, such that the facing face 118 facing the outer side 115*c* of the plate flange 115 does not come into direct contact with the plate flange 115. The separation member 119 may be formed on the facing face 118 of the combining guide 117.

The separation member 119 may have the form of a projection, which is formed to protrude from the facing face 118. The separation member 119 may protrude from the facing face 118 by being extended from the facing face 118 in the back and forth direction. There is no limitation on the shape of the separation member 119, and for example, the separation member 119 may be formed to elongate in the longitudinal direction of the combining guide 117.

A plurality of separation members 119 may be arranged along the facing face 118 at some intervals.

The separation member 119 may be an example in forming the gap G between the plate flange 115 and the exterior panel 111. In the present embodiment, the separation member 119 may have the form of a projection, without being limited thereto, forming the gap G between the plate flange 115 and the exterior panel 111.

An AC in accordance with an embodiment of the present disclosure will now be described.

Arrangements overlapping with what are described above will be omitted herein.

Figure 29:
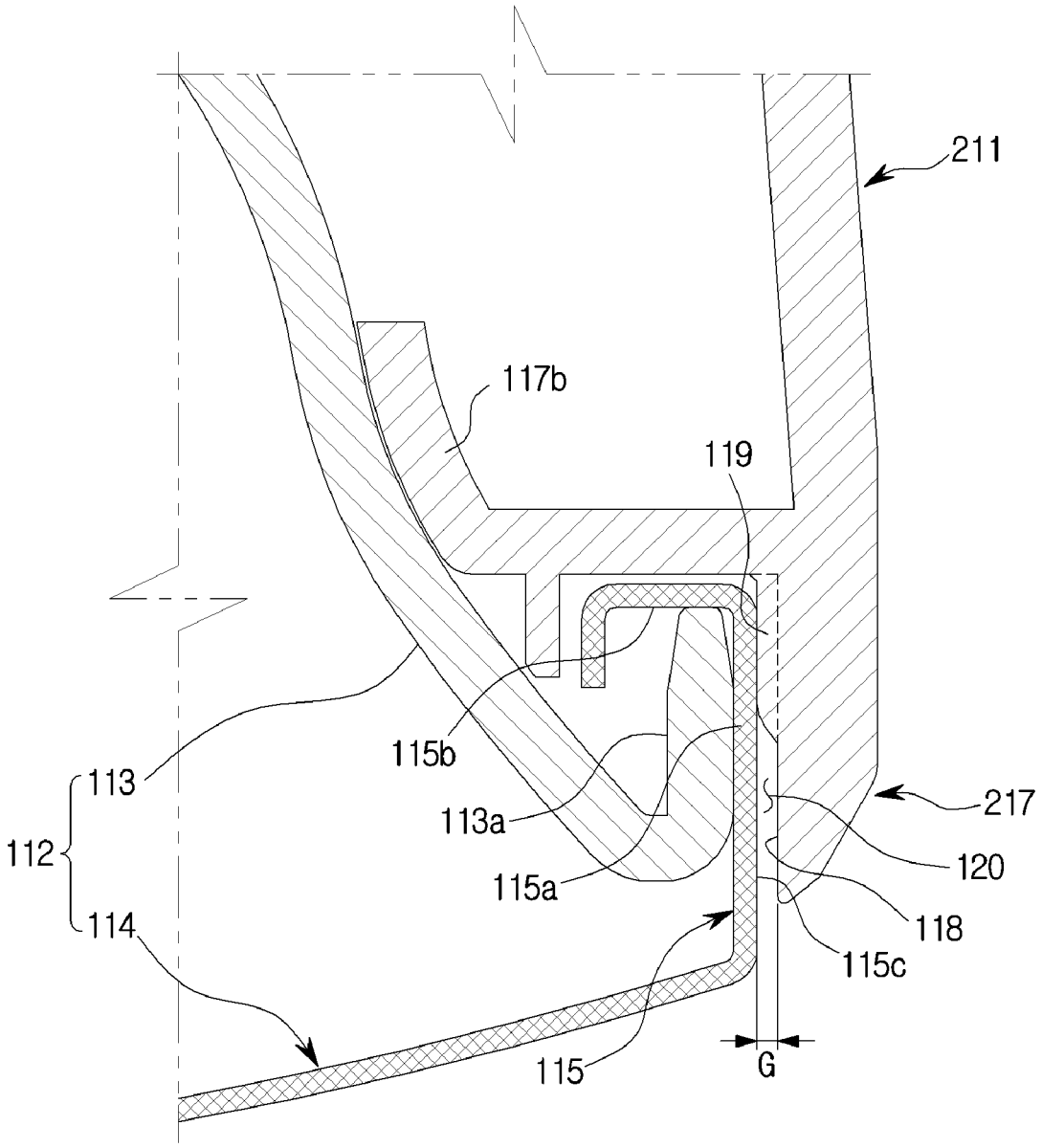
FIG. 29 is a cross-sectional view of combination of a exterior panel and a discharging panel, according to an embodiment of the present disclosure.

FIG. 29 is a cross-sectional view of combination of a exterior panel and a discharging panel, according to an embodiment of the present disclosure.

Although a combining guide 217 is separately formed from an exterior panel 211 in the embodiments of FIGS. 27 and 28, they are integrally formed in the present embodiment of FIG. 29. With this structure, the combining guide 217 may be stably supported by the exterior panel 211, and may stably support the discharging panel 112 as well. Furthermore, as the combining guide 217 is integrally formed with the exterior panel 211, errors between elements may be reduced, thereby keeping the gap G formed between the discharging plate 114 and the exterior panel 211 constant.

An AC in accordance with an embodiment of the present disclosure will now be described.

Arrangements overlapping with what are described above will be omitted herein.

Figure 30:
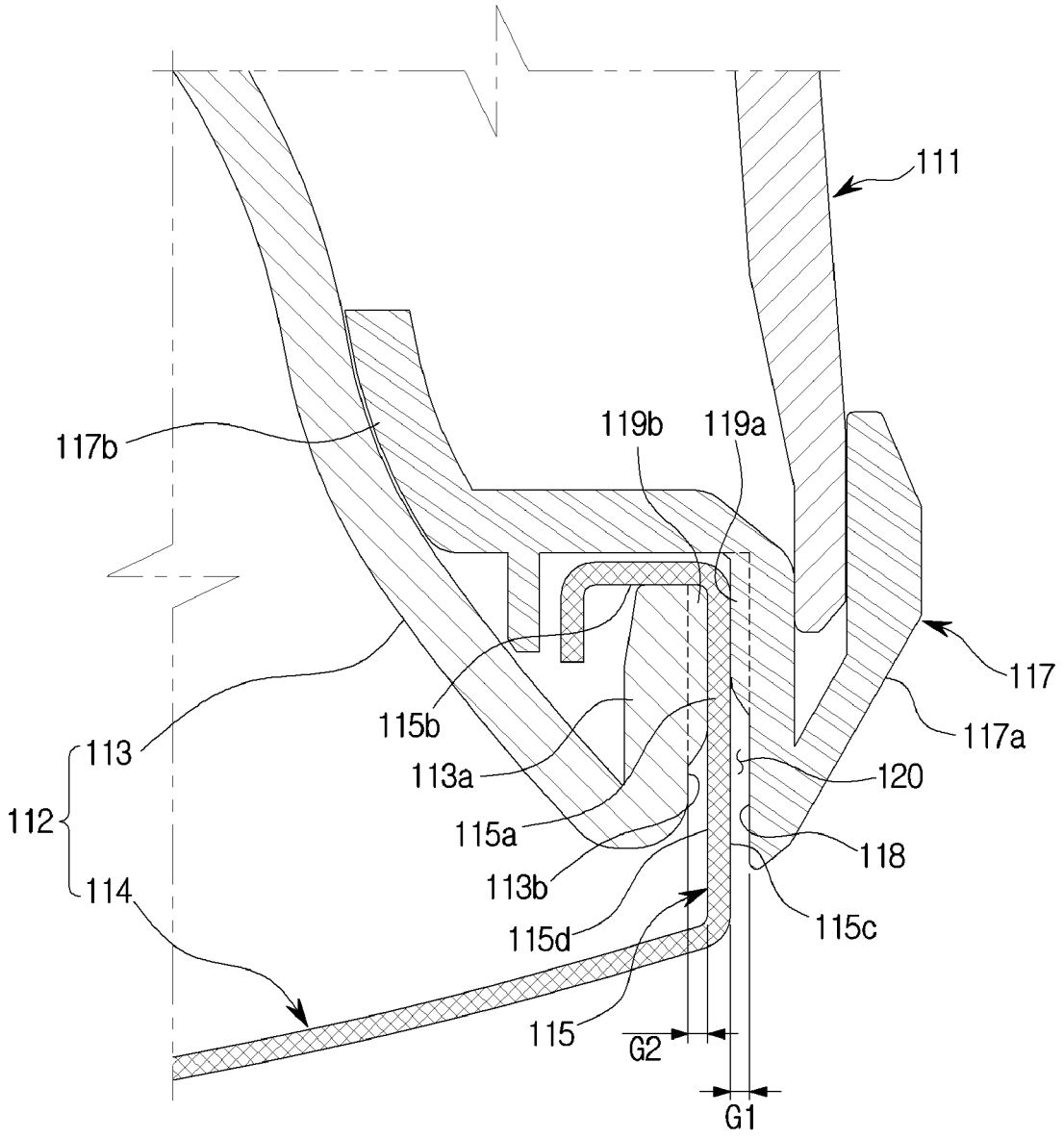
FIG. 30 is a cross-sectional view of combination of an exterior panel and a discharging panel, according to an embodiment of the present disclosure.

FIG. 30 is a cross-sectional view of combination of an exterior panel and a discharging panel, according to an embodiment of the present disclosure.

In the present embodiment, the separation member may include a first separation projection 119*a* and a second separation projection 119*b*.

The first separation projection 119*a* is arranged on the exterior panel 111 such that the outer side of the plate flange 115 and the inner side of the exterior panel 111 form a first gap G1. Specifically, the first separation projection 119*a* is formed to protrude from the facing face 118 of the combining guide to be able to contact the outer side 115*c* of the plate flange 115, whereby the facing face 118 of the combining guide and the outer side 115*c* of the plate flange 115 form the first gap G1.

The second separation projection 119*b* is arranged on the fluid path shaping frame 113 such that the inner side 115*d* of the plate flange 115 and the outer side of the fluid path frame 113 form a second gap G1. Specifically, the second separation projection 119*b* is formed to protrude from the outer side 113*b* of the fluid path shaping frame 113 to be able to contact the inner side 115*d* of the plate flange 115, whereby the outer side 113*b* of the fluid path shaping frame 115 and the inner side 115*d* of the plate flange 115 form the gap G.

As such, preventing the inner or outer side of the plate flange 115 from coming into contact with the neighboring element on the side may prevent direct heat conduction to the neighboring element while the heat exchanged air is being discharged through the discharging plate 114. It may also prevent condensation buildup on the neighboring element and improve heat efficiency. In the present embodiment, separation projections 119*a*, 119*b* are formed on the inner and outer sides of the discharging plate 114, without being limited thereto. For example, there may be a separation projection formed to be able to contact only the inner side of the plate flange 115.

An AC in accordance with an embodiment of the present disclosure will now be described.

Arrangements overlapping with what are described above will be omitted herein.

Figure 31:
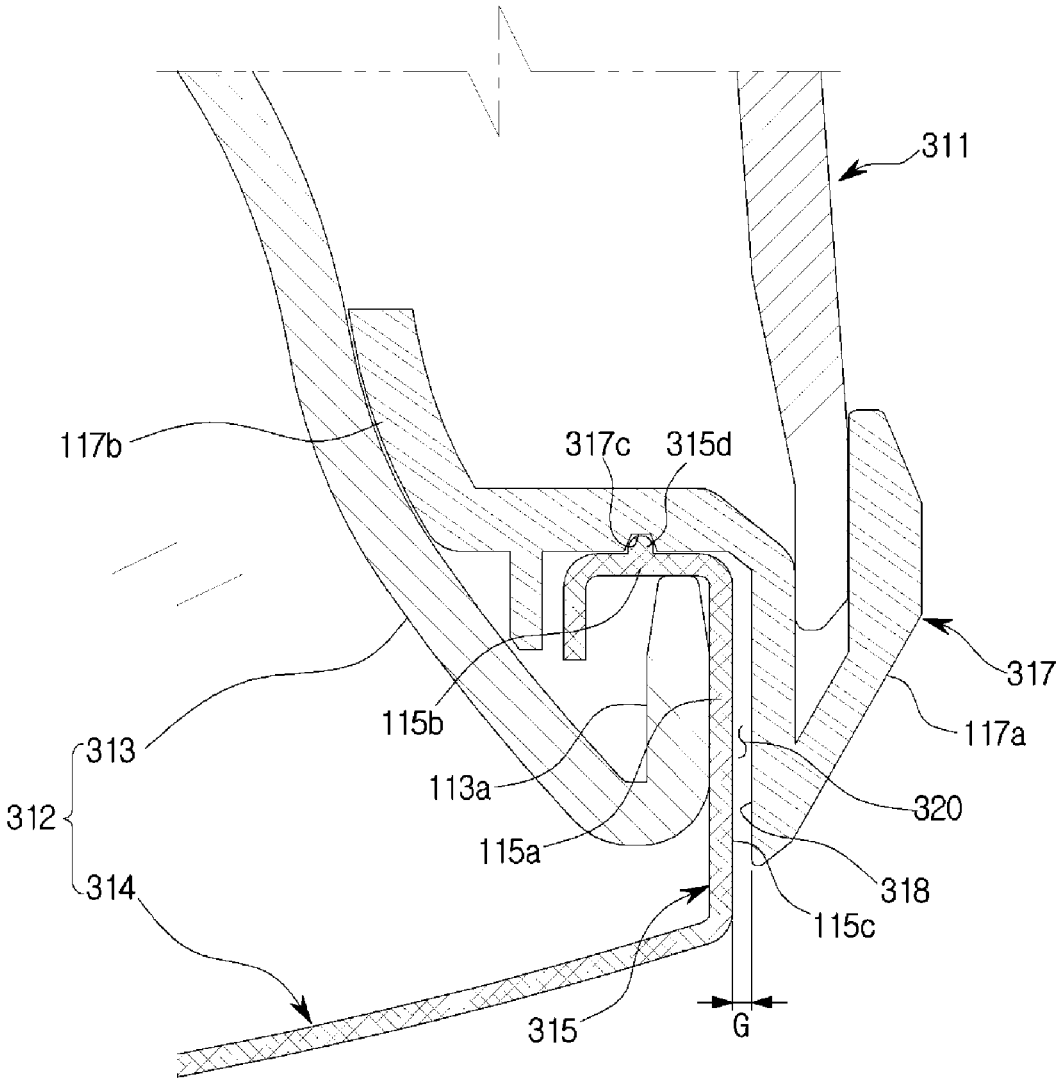
FIG. 31 is a cross-sectional view of combination of an exterior panel and a discharging panel, according to an embodiment of the present disclosure.

FIG. 31 is a cross-sectional view of combination of an exterior panel and a discharging panel, according to an embodiment of the present disclosure.

An exterior panel 311 may include a combining guide 317 combined with a fluid path shaping frame 313 to form an insertion groove 320.

A discharging plate 314 may include a plate flange 315.

The plate flange 315 may be fixed by being combined with the combining guide 317. The plate flange 315 may be fixed to the combining guide 317 by being inserted to the insertion groove 320. The plate flange 315 may be arranged to be fixed to the combining guide 317 while being separated from a facing face 318 of the combining guide that faces the plate flange 315.

The plate flange 315 may be fixed to the combining guide 317 with, for example, a fixing projection 315*d* formed on the plate flange 315 and a fixing groove 317*c* formed on the combining guide 317 to correspond to the fixing projection 315*d*. The plate flange 315 and the combining guide 317 may be fixed together by inserting the fixing projection 315*d* to the fixing groove 317*c*. The fixing projection 315*d* and the fixing groove 317*c* may be combined in the back and forth direction of the AC. This may prevent the discharging plate 314 from moving in the side direction, thereby preventing a change in width of the gap G.

In the present embodiment, the plate flange 315 is combined with the combining guide 317 but separated from the inner side of the combining guide by means of the fixing projection 315*d* and the fixing groove 317*c*, without being limited thereto. Any elements or structure may replace the fixing projection 315*d* and the fixing groove 317*c* if only the elements or structure enables the plate flange 315 to be fixed to the inner side of the combining guide 317 with some gap G.

An AC in accordance with an embodiment of the present disclosure will now be described.

Arrangements overlapping with what are described above will be omitted herein.

Figure 32:
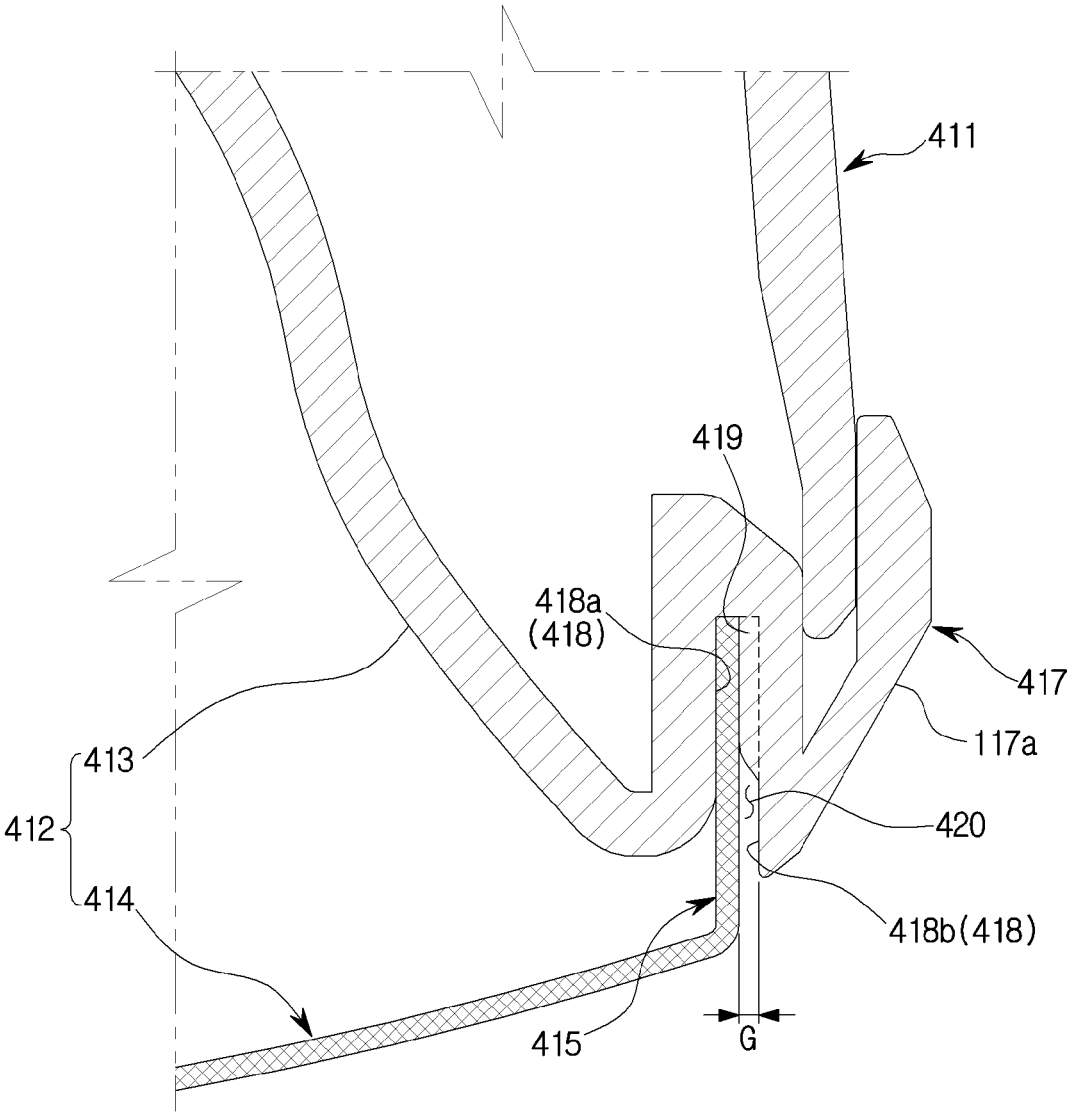
FIG. 32 is a cross-sectional view of combination of an exterior panel and a discharging panel, according to an embodiment of the present disclosure.

FIG. 32 is a cross-sectional view of combination of an exterior panel and a discharging panel, according to an embodiment of the present disclosure.

A discharging panel 412 may include a fluid path shaping frame 413 to guide the air that has exchanged heat by the heat exchanger.

The fluid path shaping frame 413 may include a combining guide 417.

The combining guide 417 is formed to fix the fluid path shaping frame 413 on the exterior panel 411. The combining guide 417 and the fluid path shaping frame 413 may be separately formed, but in the present embodiment, they are integrally formed.

The combining guide 417 may be formed along at least some portion of the circumference of the fluid path shaping frame 413. The combining guide 417 may be extended and bent several times from the fluid path shaping frame 413. The combining guide 417 may include an insertion groove 420 and insertion faces 418*a*, 418*b* to form the insertion groove 420. The insertion groove 420 may be formed to be open to the front of the AC. The insertion groove 420 is formed to have a plate flange 415 of a discharging plate 414 inserted thereto.

The combining guide 417 may include a separation member 419 formed to protrude from the insertion face. The separation member 419 may be arranged to be able to come into contact with the plate flange 415 such that the plate flange 415 is separated from the outer face of the insertion faces.

Specifically, the insertion faces may include a first insertion face 418*a* facing the inner side of the plate flange 415 and a second insertion face 418*b* facing the outer side of the plate flange 415. The separation member 419 may be formed on the second insertion face 418*b* such that the plate flange 415 and the second insertion face 418*b* may be separated with a gap G. The second insertion face 418*b* may also be referred to as a facing face 418.

The separation member 419 may have the form of a projection that may be extended in the back and forth direction of the AC. The form of the separation member 419 is not, however, limited thereto, and any form is possible if only it keeps the gap G between the plate flange 415 and the second insertion face 418*b*.

Several embodiments have been described above, but a person of ordinary skill in the art will understand and appreciate that various modifications can be made without departing the scope of the present disclosure. Thus, it will be apparent to those ordinary skilled in the art that the true scope of technical protection is only defined by the following claims.

The AC according to embodiments of the present disclosure may discharge heat exchanged air at different wind velocities.

The AC may employ different methods for blowing heat exchanged air depending on the surroundings of the user.

Furthermore, the AC may perform air conditioning in the room not to expose the user directly to the heat exchanged air, thereby increasing user satisfaction.

[Description of the Symbols]

| | |
|---|---|
| 1: Air Conditioner (AC) | 10: Housing |
| 11: Exterior Panel | 12: Discharging Panel |
| 13: Fluid Path Shaping Frame | 14: Discharging Plate |
| 20: Heat Exchanger | 30: Blower |
| 40: Air Discharger | 41: First Discharger |
| 41a: First Discharging Fluid Path | 43: Guide Opening |
| 45: Discharging Guide | 46: Guide Body |
| 47: Guide Groove | 50: Second Discharger |
| 50a: Second Discharging Fluid Path | 60: Door Unit |

What is claimed is:

1. An air conditioner (AC), comprising:

a housing including a discharge plate;

a heat exchanger arranged to exchange heat with air in the housing of the AC;

a fan arranged inside the housing to blow the heat exchanged air out of the housing; and wherein the discharge plate is a front surface of the housing and includes:

an opening formed on the front surface of the housing to discharge the heat exchanged air blown from the fan out of the front surface of the housing, the opening being arranged along a blowing direction of the fan, and a plurality of discharge holes, formed throughout the front surface of the housing, to discharge the heat exchanged air out of the front surface of the housing along a direction facing the blowing direction of the fan, a first plate combiner arranged along a circumference of the discharge plate to correspond to a first projection arranged along at least a portion of a circumference of the housing, such that the discharge plate is fixed to the housing when the first projection is inserted to the first plate combiner, wherein the front surface of the housing on which both the opening and the plurality of discharging holes are formed is facing the blowing direction of the fan.

2. The AC of claim 1, wherein the discharge plate is made of metal, and a process of forming the discharge plate includes a press forming process.

3. The AC of claim 1, further comprising:

a fluid path shaping frame defining a fluid path to guide the air discharged from the fan; and a discharge guide arranged between the fluid path shaping frame and the discharge plate for guiding airflow from the fan to the opening, wherein the discharge plate comprises a second plate combiner arranged along a circumference of the opening to correspond to a second projection arranged along at least a portion of the circumference of the discharge guide, such that the discharge guide is fixed to the discharge plate when the second projection is inserted to the second plate combiner.

4. An air conditioner (AC), comprising:

a housing including a discharge plate;

a heat exchanger arranged to exchange heat with air in the housing of the AC;

a fan arranged inside the housing to blow the heat exchanged air out of the housing; and wherein the discharge plate is formed to be coupled to the housing along a circumference of the discharge plate such that the discharge plate couples to the housing to thereby define a front planar exterior surface of the housing, and an entire portion of the discharge plate that defines the front planar exterior surface of the housing extends along a vertical direction of the housing and faces a blowing direction of the fan, the discharge plate including:

an opening to discharge the heat exchanged air blown from the fan out of the front planar exterior surface of the housing, and a plurality of discharge holes to discharge the heat exchanged air out of the front planar exterior surface of the housing between an outer circumference of the opening and the circumference of the discharge plate, a fluid path shaping frame defining a fluid path to guide the air discharged from the fan; and a discharge guide arranged between the fluid path shaping frame and the discharge plate for guiding airflow from the fan to the opening, wherein the discharge plate comprises:

a plurality of first plate combiners formed along a circumference of the discharge plate, and combined with the housing by being bent; and a plurality of second plate combiners formed along a circumference of the opening, and combined with the discharge guide by being bent.

5. An air conditioner (AC), comprising:

a housing including a discharge panel;

a heat exchanger arranged inside the housing of the AC to exchange heat with air; and a fan arranged inside the housing to blow the heat exchanged air out of the housing, wherein the discharge panel plate is formed to be coupled to the housing along a circumference of the discharge plate such that the discharge plate couples to the housing to thereby define a front planar exterior surface of the housing and includes:

an opening to discharge the heat exchanged air blown by the fan out of the front planar exterior surface of the housing, and a plurality of discharge holes to discharge the heat exchanged air blown by the fan out of the front planar exterior surface of the housing; and a combining guide arranged between the discharge panel and the housing such that a portion of the discharge plate is inserted into the discharge plate to combine the discharge panel with the housing, and wherein an entire portion of the discharge plate that defines the front planar exterior surface of the housing extends along a vertical direction of the housing and faces a blowing direction of the fan, wherein the combining guide comprises:

a panel combiner on one side of the combining guide to be combined with the housing; and a frame combiner on another side of the combining guide to be combined with the discharge panel.

6. The AC of claim 5, wherein the combining guide is integrally formed with the housing.

7. The AC of claim 5, wherein the combining guide is integrally formed with the discharge panel.

8. The AC of claim 5, wherein the discharge panel comprises a fluid path shaping frame and a discharge plate to form a fluid path for discharging the heat exchanged air, wherein the combining guide is combined with the fluid path shaping frame and the discharge plate.

9. An air conditioner (AC), comprising:

a housing including a discharge plate;

a heat exchanger arranged inside the housing to exchange heat with air flowing from outside the housing; and a frame arranged for partitioning an inside of the housing, the frame forming a space with the discharge plate, wherein the discharge plate is formed to be coupled to the housing along a circumference of the discharge plate such that the discharge plate couples to the housing to thereby define a front planar exterior surface of the housing, the discharge plate includes:

an opening to discharge the heat exchanged air via the front planar exterior surface of the housing and a plurality of discharge holes to discharge the heat exchanged air via the front planar exterior surface of the housing, a plate flange arranged to bend along at least a portion of the circumference of the discharge plate and to form a gap from one side of the housing, and wherein an entire portion of the discharge plate that defines the front planar exterior surface of the housing extends along a vertical direction of the housing and faces a blowing direction of the fan, a combining guide arranged between the frame and the housing for combining the frame with the housing, wherein the combining guide comprises a first separation projection protruding from one side of the housing to form a gap between the plate flange and the one side of the housing to separate the one side of the housing from the plate flange, wherein the frame comprises a second separation projection protruding from one side of the frame to form a gap between the plate flange and the one side of the frame to separate the one side of the frame from the plate flange.

10. The AC of claim 9, wherein the discharge plate is arranged to form the gap between an inner side of the housing and an outer side of the plate flange.

11. The AC of claim 9, further comprising:

a separation member located between the plate flange and the housing, such that the plate flange is separated from one side of the housing.

12. The AC of claim 11, wherein the housing comprises a facing face to face the plate flange, wherein the separation member protrudes from the facing face to separate the plate flange from the facing face.

13. The AC of claim 12, wherein the separation member includes a first separation projection and a second separation projection arranged to be separated from each other along the facing face.

14. The AC of claim 12, further comprising:

a combining guide arranged between the frame and the housing for combining the frame with the housing, wherein the separation member is formed on the combining guide.

15. The AC of claim 14, wherein the combining guide is integrally formed with the housing.

16. The AC of claim 9, further comprising:

wherein the combining guide comprises a concave fixing groove formed on one side of the combining guide, wherein the plate flange comprises a fixing projection inserted into and fixed to the fixing groove to maintain the gap.

* * * * *